US009303235B2

(12) United States Patent
Navarro

(10) Patent No.: US 9,303,235 B2
(45) **Date of Patent: *Apr. 5, 2016**

(54) ENVIRONMENTALLY FRIENDLY PACKAGING ASSEMBLY AND A CANDLE EMBODYING THE SAME

(71) Applicant: Catalina Navarro, Toronto (CA)

(72) Inventor: Catalina Navarro, Toronto (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/507,293

(22) Filed: Oct. 6, 2014

(65) Prior Publication Data

US 2015/0024329 A1 Jan. 22, 2015

Related U.S. Application Data

(62) Division of application No. 13/038,037, filed on Mar. 1, 2011, now Pat. No. 8,882,495.

(60) Provisional application No. 61/325,844, filed on Apr. 20, 2010.

(51) Int. Cl.
*F23D 3/16* (2006.01)
*C11C 5/00* (2006.01)
(Continued)

(52) U.S. Cl.
CPC . *C11C 5/008* (2013.01); *B65B 5/02* (2013.01); *B65D 1/22* (2013.01); *B65D 1/40* (2013.01); *B65D 13/00* (2013.01); *B65D 15/02* (2013.01); *B65D 43/022* (2013.01); *B65D 77/048* (2013.01); *B65D 81/36* (2013.01);
(Continued)

(58) Field of Classification Search
CPC ..... C11C 5/008; F21V 35/00
USPC ..... 431/288, 289, 290, 291, 292–297, 431/324–325
See application file for complete search history.

(56) References Cited

U.S. PATENT DOCUMENTS 1,608,518 A 11/1926 Minrath
2,298,480 A * 10/1942 Harvey ..... 215/326
(Continued)

FOREIGN PATENT DOCUMENTS

GB 1391958 4/1975
JP 6194540 6/1986
(Continued)

OTHER PUBLICATIONS

Translation of JP 61094540.*

*Primary Examiner* — Avinash Savani
*Assistant Examiner* — Vivek Shirsat
(74) *Attorney, Agent, or Firm* — Sand & Sebolt

(57) ABSTRACT

An environmentally friendly product packaging assembly having a secondary use after a product has been removed therefrom. The packaging assembly comprises a candle having a wall made of a vaporizable material and defining a cavity therein for retaining the product. The candle includes a wick embedded in the wall in a spiral, coiled or helical fashion and positioned to substantially encircle the cavity. The assembly may include a containment mechanism that at least partially restricts access to the cavity and thereby aids in retaining the product therein. The assembly may further include a base positioned under a bottom end of the candle. The containment mechanism and base may themselves be made out of recyclable or combustible materials. Once the product has been removed from the cavity, the assembly may be used as a conventional candle. The candle wall is vaporized leaving little to no waste for disposal.

18 Claims, 22 Drawing Sheets

(51) Int. Cl.

| | |
|---|---|
| ***B65D 1/22*** | (2006.01) |
| ***B65D 1/40*** | (2006.01) |
| ***B65D 13/00*** | (2006.01) |
| ***B65D 8/00*** | (2006.01) |
| ***B65D 43/02*** | (2006.01) |
| ***B65D 77/04*** | (2006.01) |
| ***B65D 81/36*** | (2006.01) |
| ***B65B 5/02*** | (2006.01) |

(52) U.S. Cl.

CPC ..... *B65D2543/0049* (2013.01); *B65D 2543/00074* (2013.01); *B65D 2543/00092* (2013.01); *B65D 2543/00148* (2013.01); *B65D 2543/00194* (2013.01); *B65D 2543/00212* (2013.01); *B65D 2543/00268* (2013.01); *B65D 2543/00277* (2013.01); *B65D 2543/00296* (2013.01); *B65D 2543/00305* (2013.01); *B65D 2577/043* (2013.01)

(56) References Cited

U.S. PATENT DOCUMENTS

| | | | | | |
|---|---|---|---|---|---|
| 2,962,205 | A | * | 11/1960 | McFarland | 229/309 |
| 4,696,640 | A | | 9/1987 | Pitchford | |
| 4,790,747 | A | | 12/1988 | O'Brien | |
| 6,056,541 | A | | 5/2000 | Gerszewski | |
| 7,614,876 | B1 | | 11/2009 | Ward-Kubik | |
| 2008/0268390 | A1 | | 10/2008 | Alusi | |

FOREIGN PATENT DOCUMENTS

| | | |
|---|---|---|
| JP | 08048992 | 2/1996 |
| KR | 20020093644 | 12/2002 |
| WO | 9509222 | 4/1995 |

* cited by examiner

ENVIRONMENTALLY FRIENDLY PACKAGING ASSEMBLY AND A CANDLE EMBODYING THE SAME

CROSS-REFERENCE TO RELATED APPLICATIONS

This application is a divisional of U.S. patent application Ser. No. 13/038,037 filed Mar. 1, 2011, which application claims the benefit of U.S. Provisional Application Ser. No. 61/325,844 filed Apr. 20, 2010, the entire specifications of which are incorporated herein by reference.

BACKGROUND OF THE INVENTION

1. Technical Field

The invention relates generally to packaging for retail products. More particularly, the invention relates to an environmentally friendly packaging assembly that is able to serve both a primary function of retaining a product and a secondary function once the product is removed therefrom. Specifically, the invention relates to an environmentally friendly packaging assembly in the form of a candle that is configured to retain a product within a cavity and which may be substantially consumed by burning after the product is removed so that little to no significant waste is left for disposal.

2. Background Information

Product packaging is a substantial market in the United States and throughout the world. Packaging is necessary to ensure that a product will reach the end consumer in pristine condition. Furthermore, packaging is required at various stages from the original product manufacturing to bulk shipping to retail store sales. Many products are packaged in individual containers which are then palletized to be shipped to distributors. This individual packaging of the products ensures that the product is not damaged during transit or subsequent handling by consumers. Packaging also provides the manufacturer and retailer the opportunity to advertise the benefits and ingredients of their products. Packaging with designs that are flashy or colorful can help urge consumers towards the purchase of a particular product. In addition, the use of a special ingredient highlighted on a packaging may also help entice consumers that this particular product is the one they should buy.

Growing concerns over global warming and overcrowded landfills have created a push towards using naturally based products that are more environmentally friendly. Environmentally friendly products include biodegradable materials or materials that can easily be recycled or reused. Still further, manufacturers can utilize recycled materials within their packaging. While each of these initiatives helps reduce the environmental impact, each solution still produces some sort of waste that must be disposed of in landfills.

Packaging also provides the disadvantage of being essentially a throwaway component of the product. For example, an end user opens the packaging to obtain the product retained therein and then merely disposes of the packaging. This waste of the packaging materials is not only costly for the manufacturer and the consumer but is also costly for the environment as discussed above. The inability to reuse the packaging for different products or for a different purpose remains a concern for the packaging industry. Still further, the packaging industry is not able to tout the product packaging as a secondary reason for the purchasing of the product.

SUMMARY OF THE INVENTION

The present invention broadly comprises a packaging assembly that is environmentally friendly in that it has a secondary use and during that secondary use, substantially the entire packaging is consumed leaving little to no waste to be introduced into a landfill. The packaging assembly comprises a candle having a wall made of a vaporizable material and defining a cavity therein for retaining the product. The candle includes a wick that is embedded in the wall in a spiral, coiled or helical fashion and positioned so that it substantially encircles the cavity defined in the wall. The assembly may further include a containment mechanism that at least partially restricts access to the cavity to retain the product therein and a base upon which a bottom end of the candle is seated. The containment mechanism and base may themselves be made out of recyclable materials or combustible materials similar to the candle and may be provided with a second wick to consume the same by burning.

BRIEF DESCRIPTION OF THE DRAWINGS

A preferred embodiment of the invention, illustrative of the best mode in which Applicant has contemplated applying the principles of the invention, is set forth in the following description and is shown in the drawings and is particularly and distinctly pointed out and set forth in the appended claims.

Similar numbers refer to similar parts throughout the drawings.

DESCRIPTION OF THE PREFERRED EMBODIMENTS

At the outset, it should be appreciated that like drawing numbers on different drawing views identify identical, or functionally similar, structural elements of the invention. While the present invention is described with respect to what is presently considered to be the preferred embodiments, it is to be understood that the invention as claimed is not limited to the disclosed aspects.

Unless defined otherwise, all technical and scientific terms used herein have the same meaning as commonly understood to one of ordinary skill in the art to which this invention belongs. Although any methods, devices or materials similar or equivalent to those described herein may be used in the practice or testing of the invention, the preferred methods, devices, and materials are now described.

Figure 5:
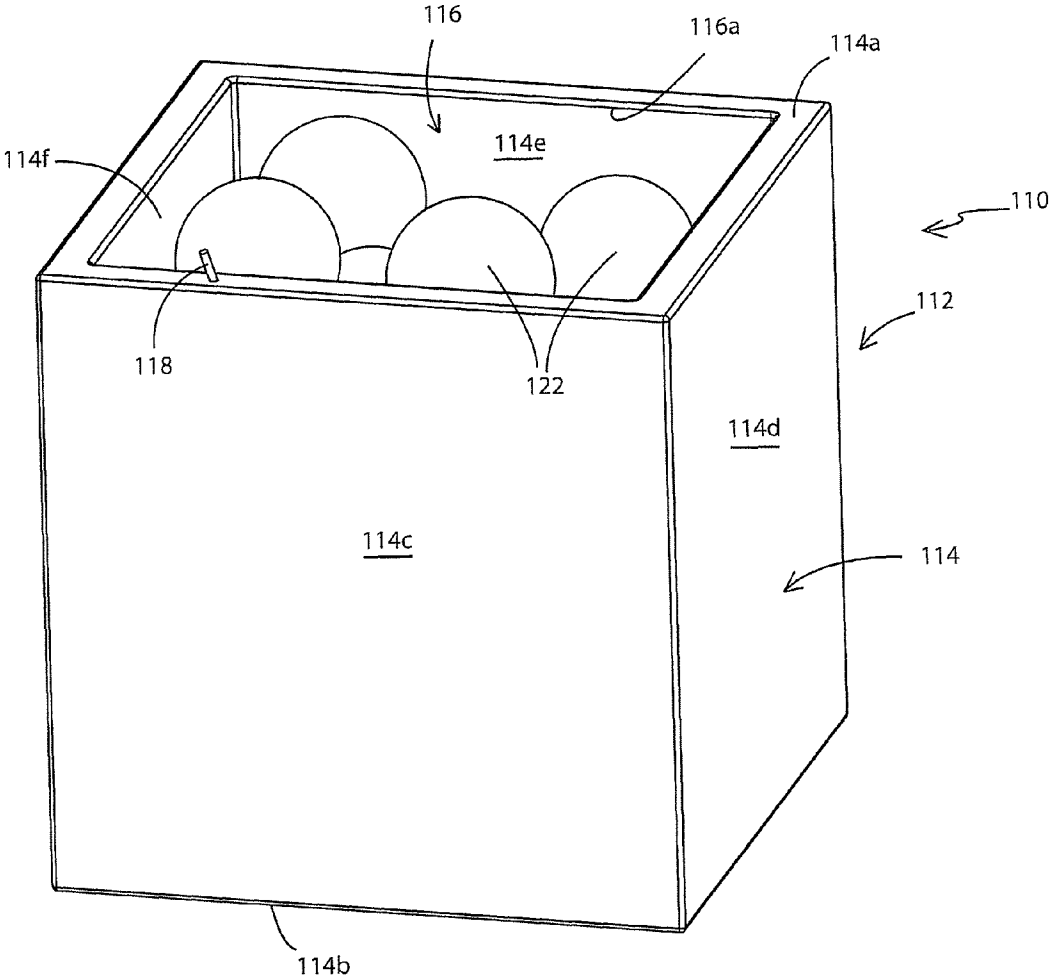
FIG. 5 is a perspective view of a second embodiment of a candle utilized as an environmental packaging assembly in accordance with the present invention and showing product retained within a cavity in the candle.
Figure 6:
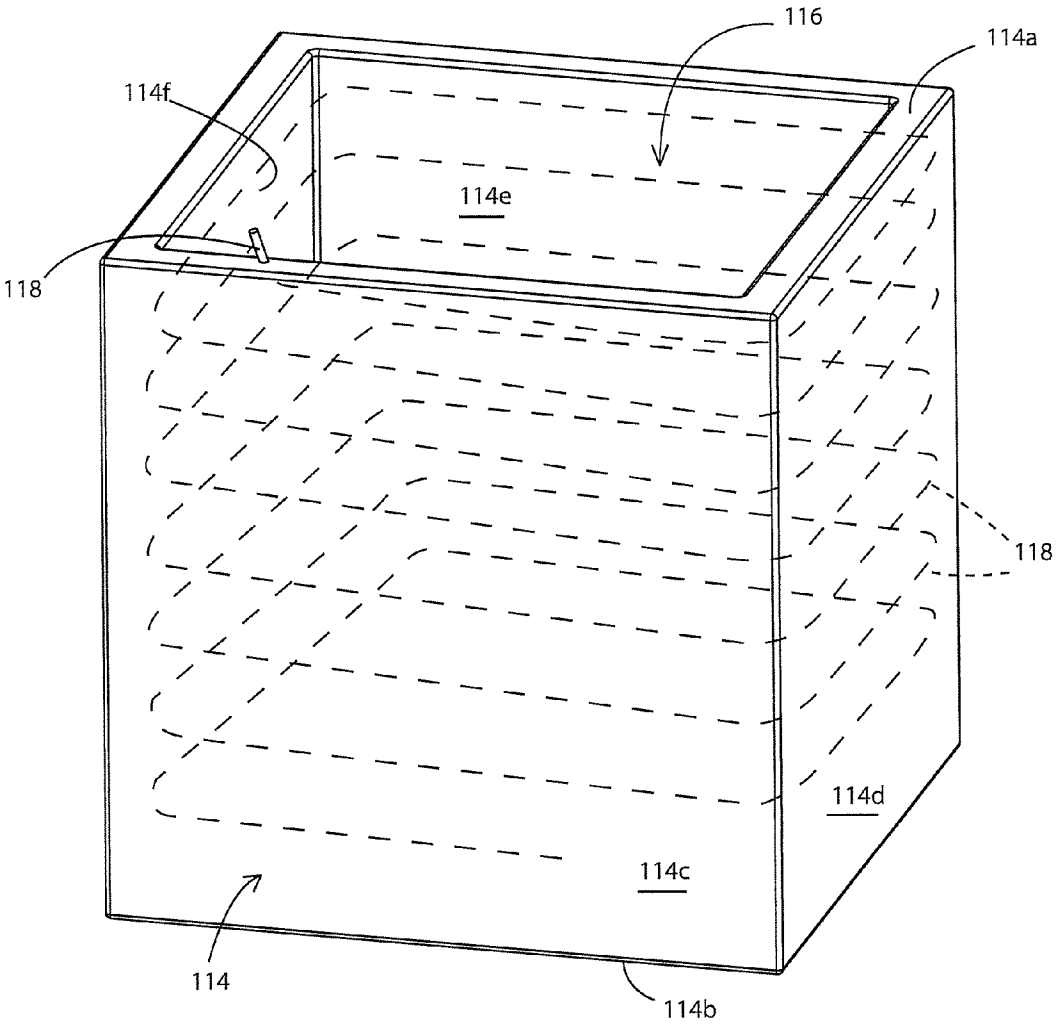
FIG. 6 is a perspective view of the candle of FIG. 5 with the product removed and showing the placement of the wick in the wall of the candle.
Figure 7:
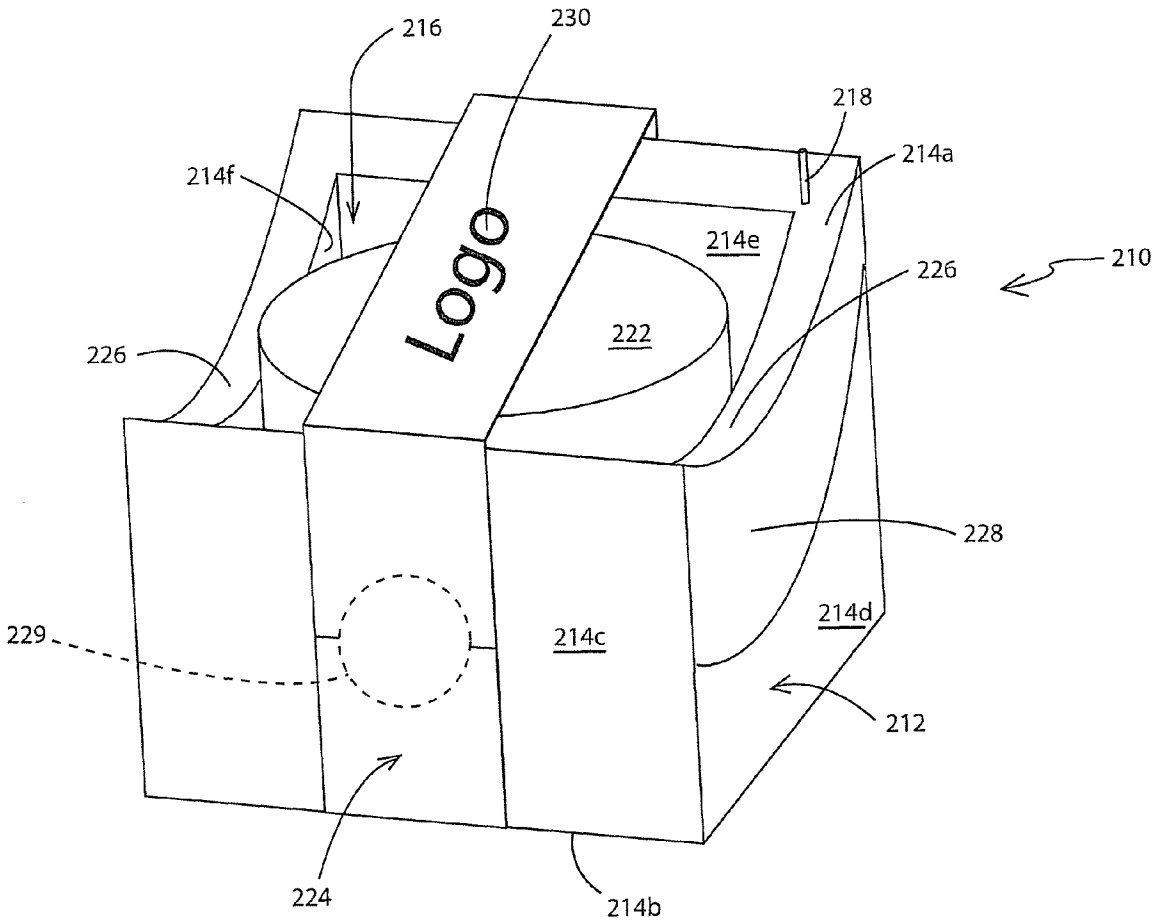
FIG. 7 is a perspective view of a third embodiment of a candle utilized as an environmental packaging assembly in accordance with the present invention and illustrating a first type of containment mechanism closing off access to a portion of the cavity in the candle and thereby retaining a product within that cavity.
Figures 8A, 8B:
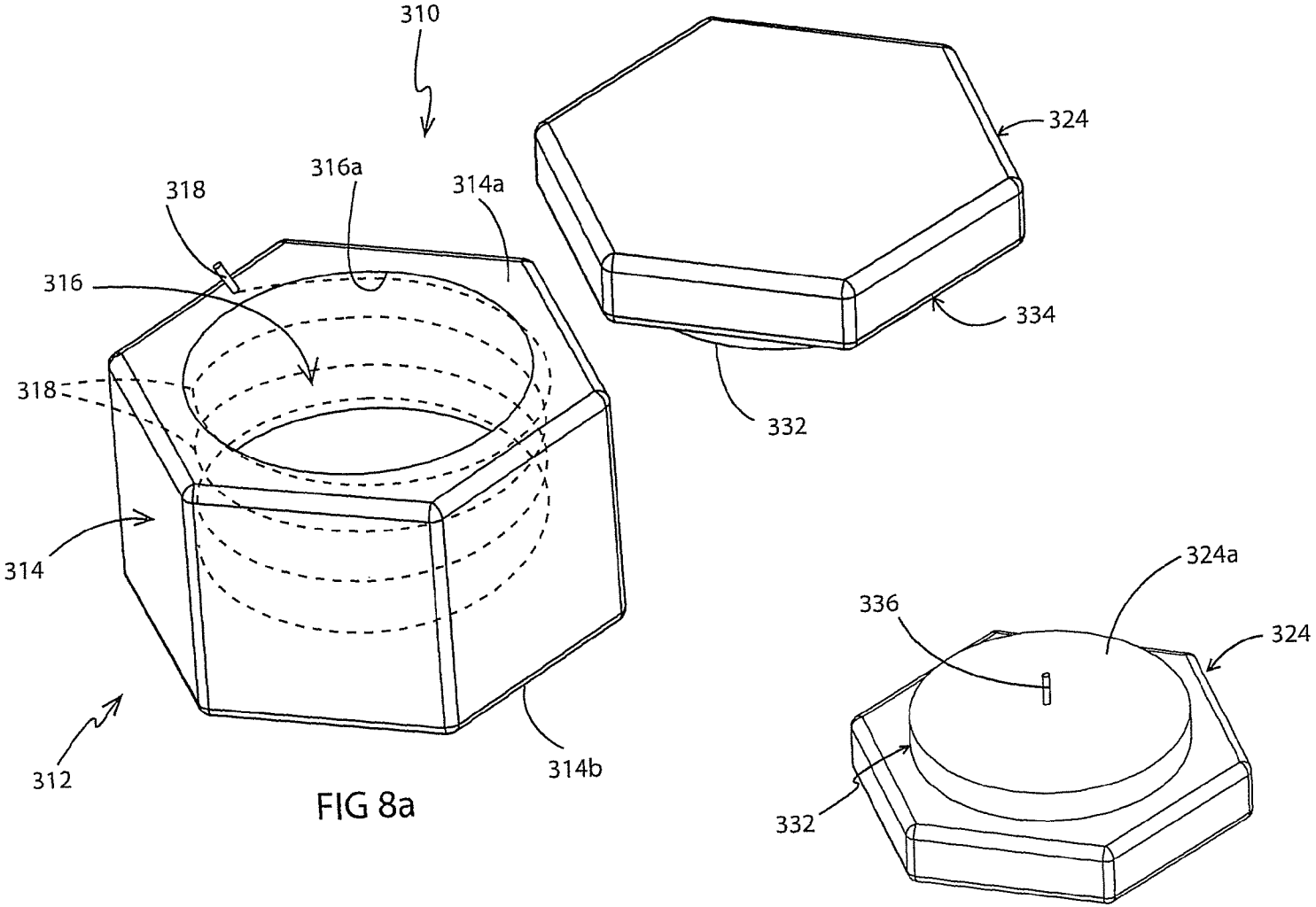
FIG. 8*a* is a perspective view of a fourth embodiment of a candle used as an environmental packaging assembly in accordance with the present invention and illustrating a second type of containment mechanism for closing off access to the cavity in the candle.
FIG. 8*b* is a perspective view of the lid of the environmental packaging assembly of FIG. 8*a* shown inverted and in position to be used as a tea light.
Figure 9:
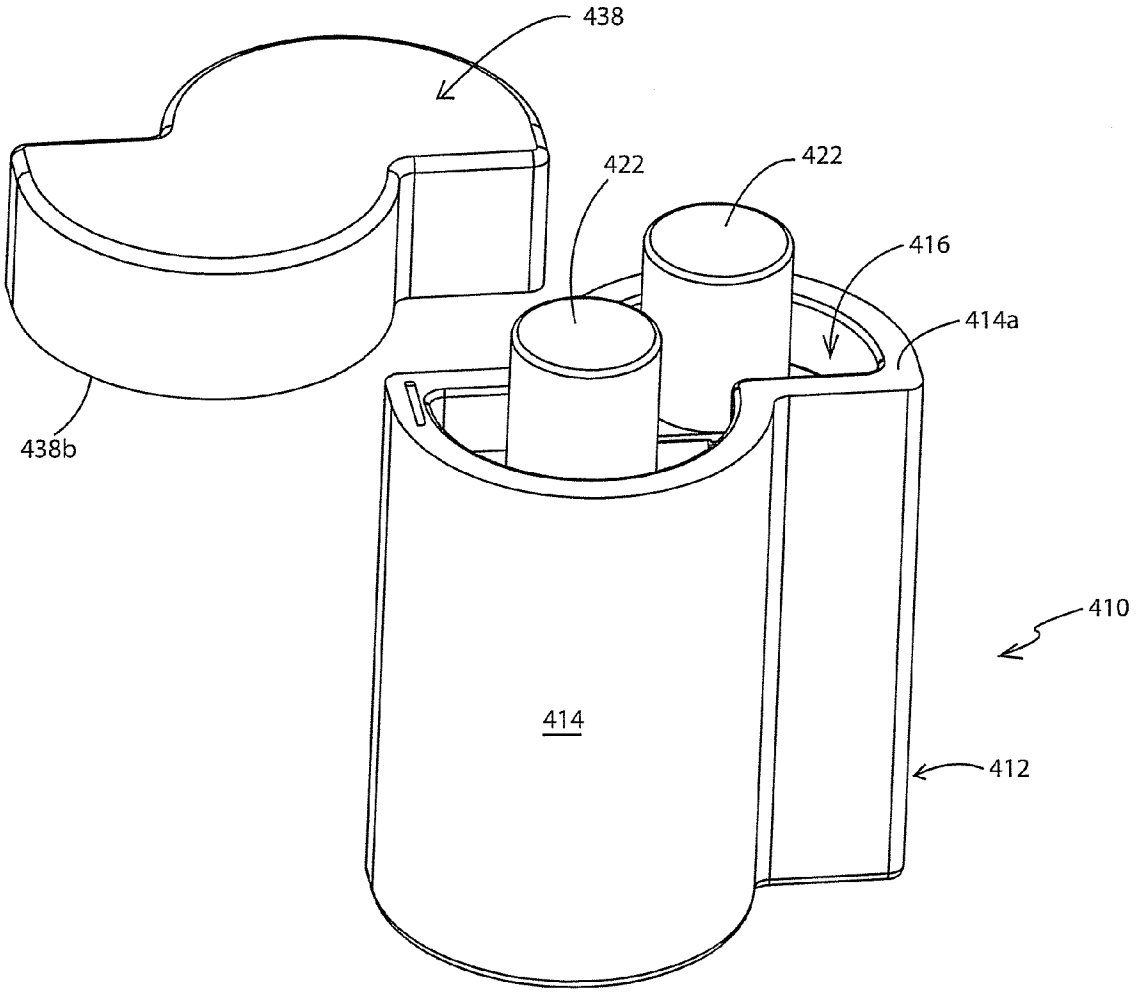
FIG. 9 is a perspective view of a fifth embodiment of a candle utilized as an environmental packaging assembly in accordance with the present invention and illustrating a third type of containment mechanism for closing off access to the cavity in the candle.
Figure 10:
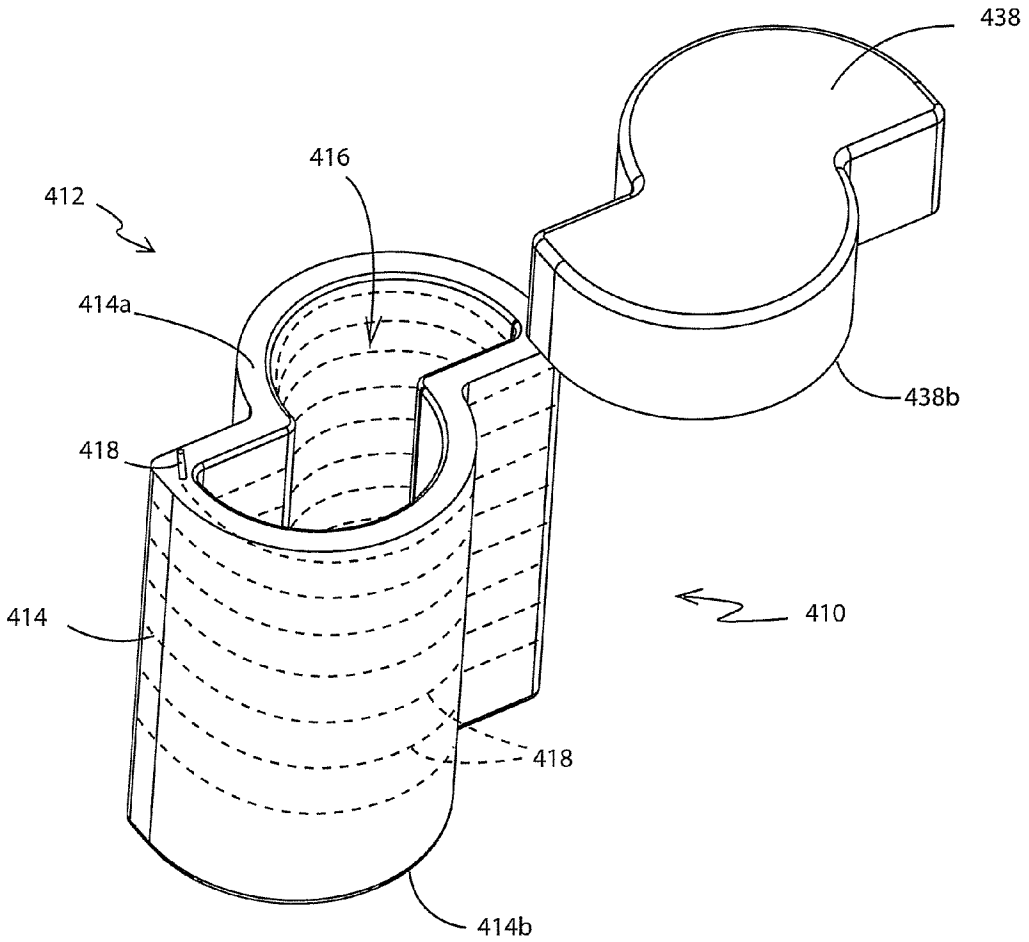
FIG. 10 is a perspective view of the candle of FIG. 9 with the product removed from the cavity and showing the wick encircling the cavity and showing a second wick in the containment mechanism.
Figure 11:
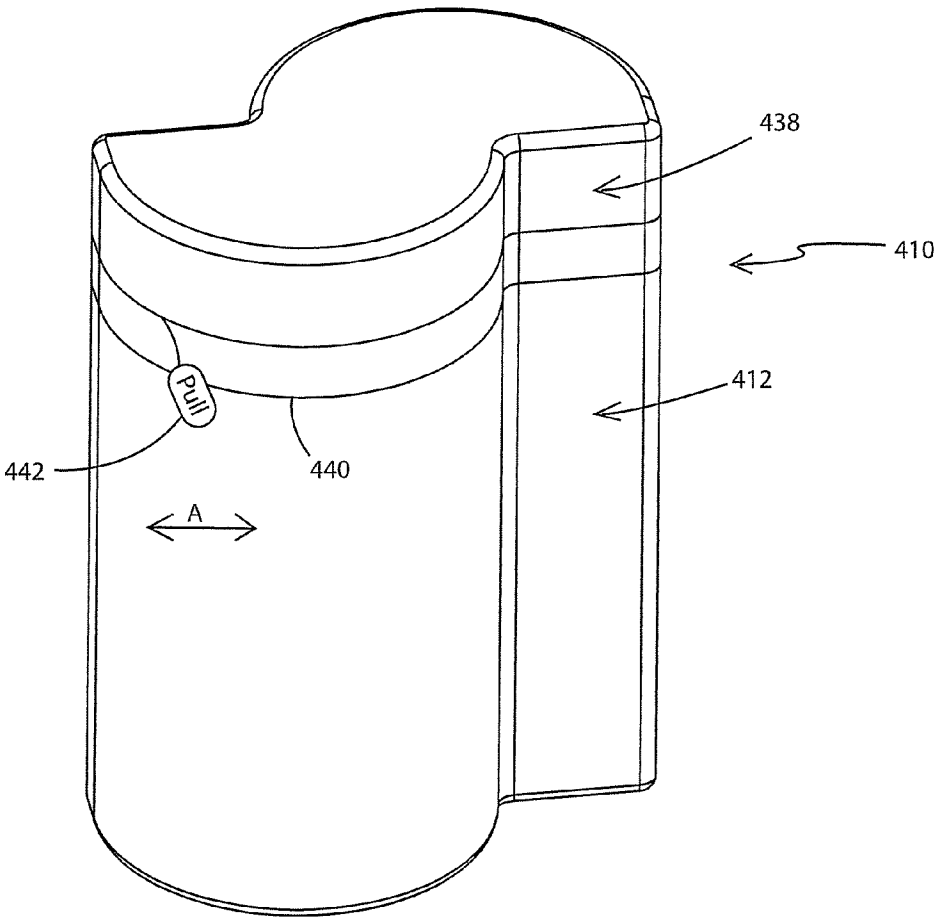
FIG. 11 is a perspective view of the candle of FIG. 9 showing an adhesive layer disposed between the candle and the containment mechanism and the end of a pull-tab for breaking the seal of the adhesive layer.
Figure 12:
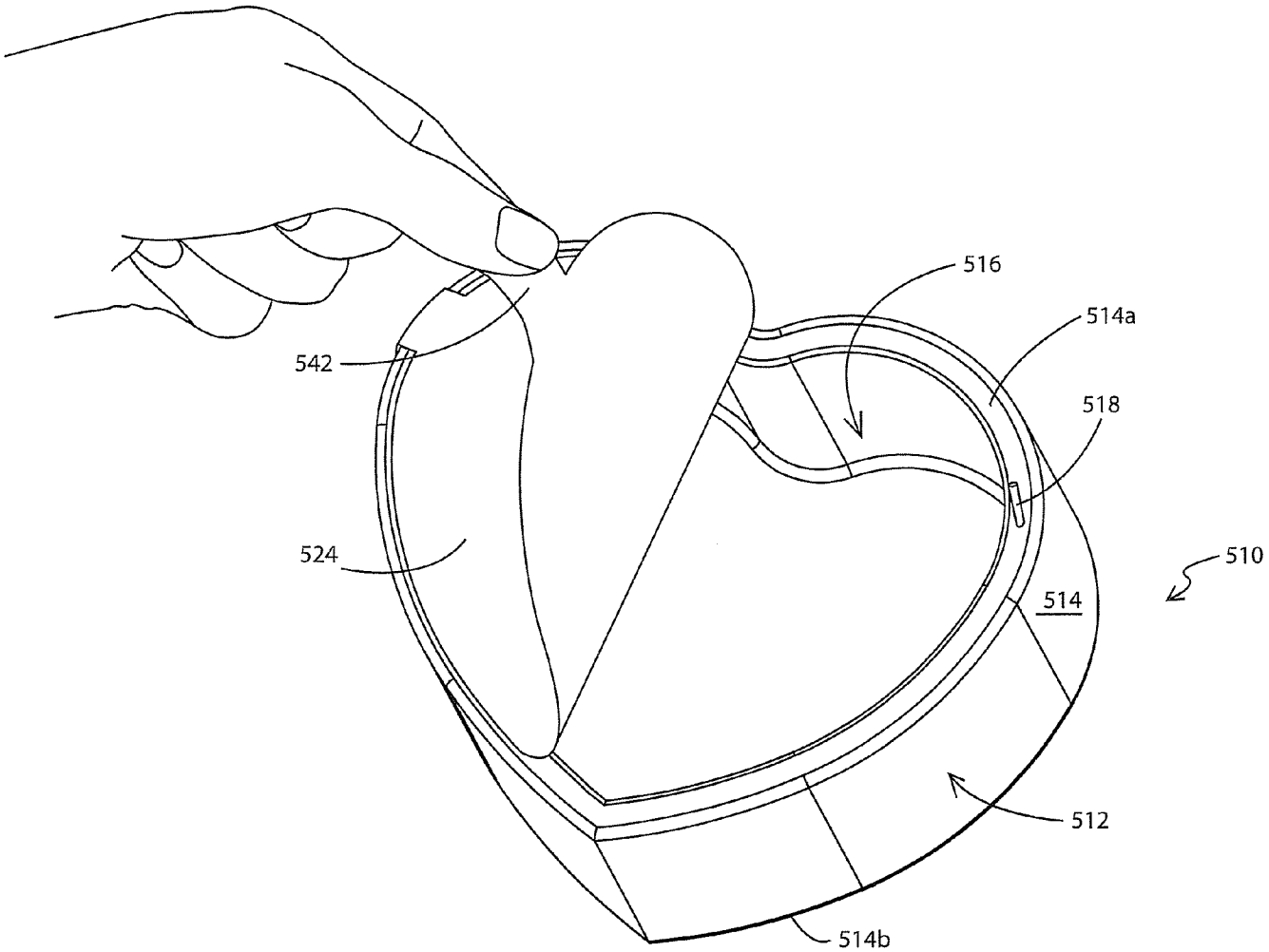
FIG. 12 is a perspective view of a sixth embodiment of a candle that is utilized as an environmental packaging assembly showing a fourth type of containment mechanism for closing off access to the cavity in the candle.
Figure 13:
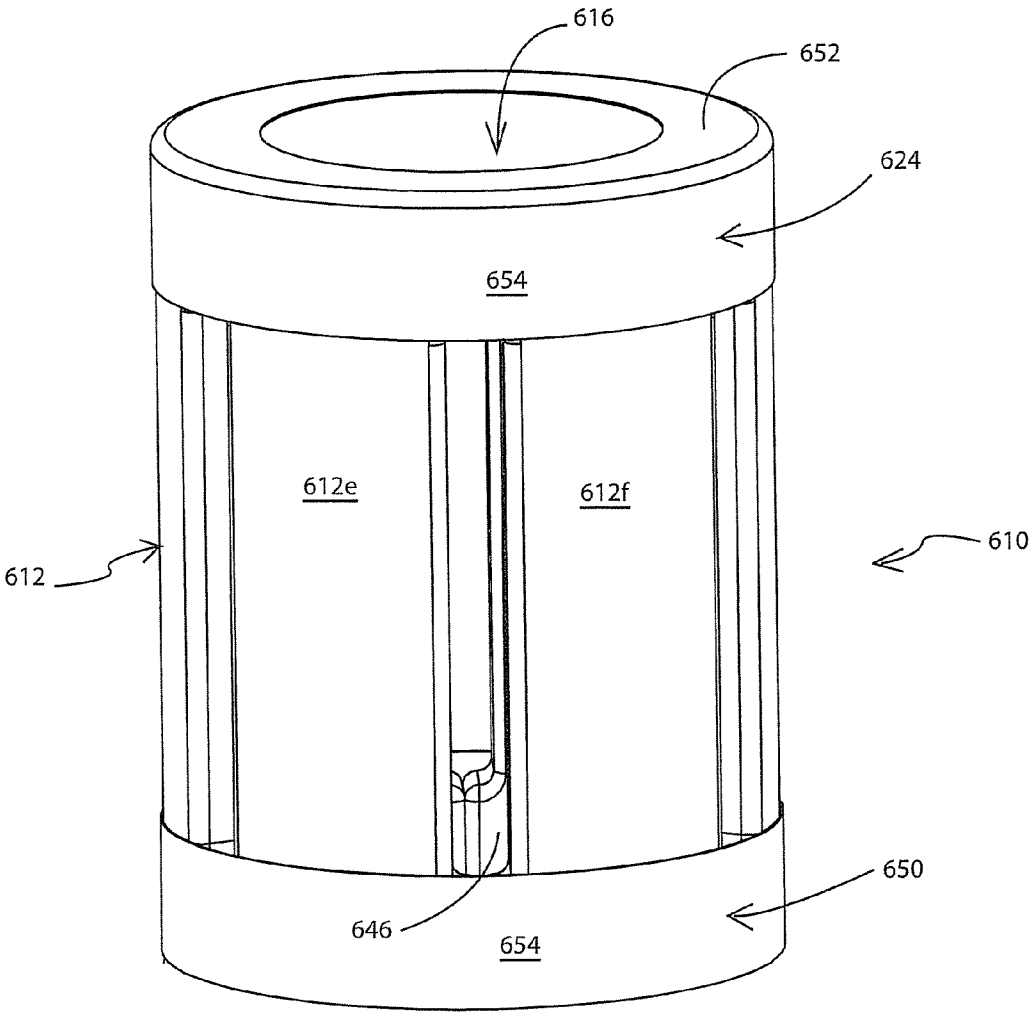
FIG. 13 is a perspective view of a seventh embodiment of a candle that is utilized as an environmental packaging assembly in accordance with the present invention.
Figure 14:
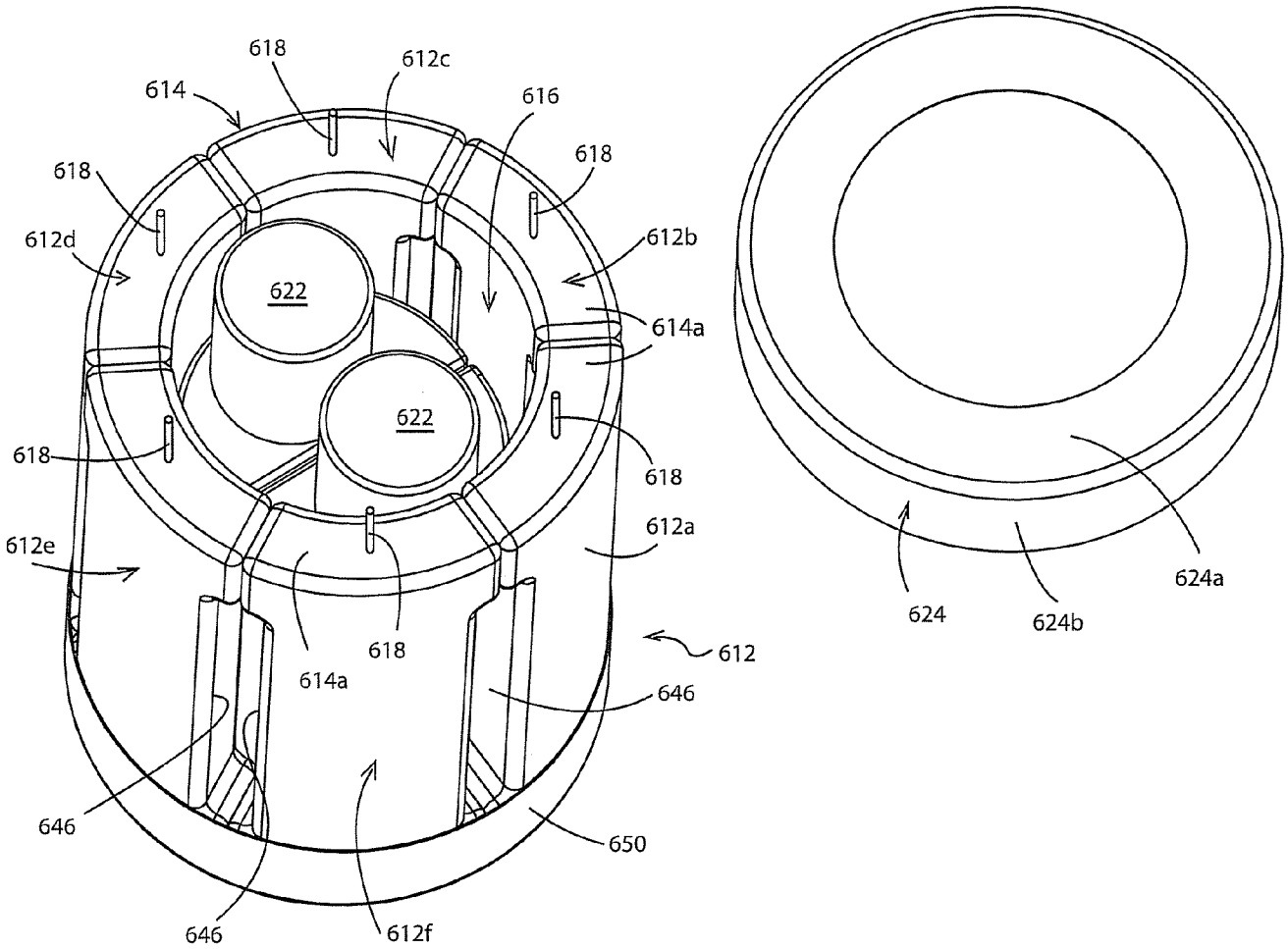
FIG. 14 is a perspective view of the candle of FIG. 13 with the containment mechanism removed from a top end of the candle and showing product retained within the cavity, and further showing that the candle itself is comprised of several candle portions.
Figure 15:
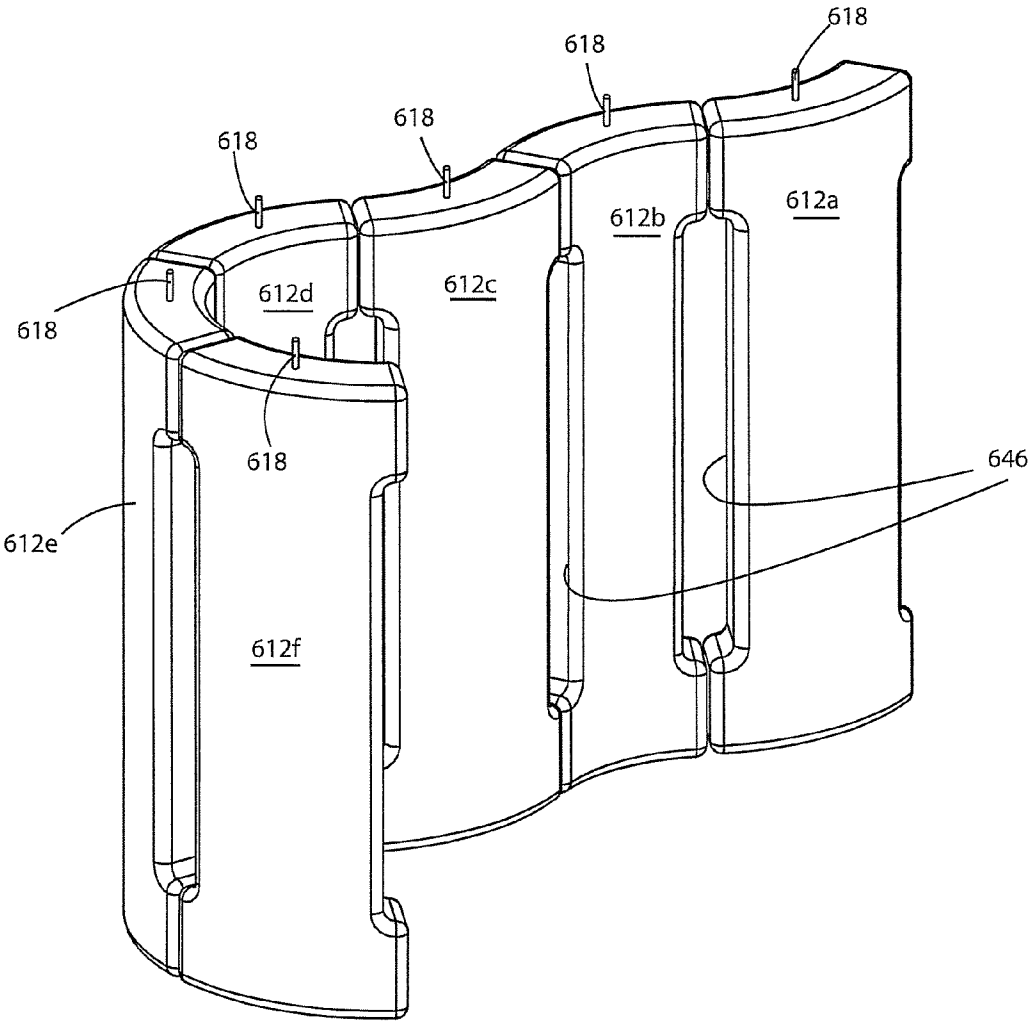
FIG. 15 is a perspective view of the candle of FIG. 13 with both the containment mechanism and base removed and illustrating the several candle portions disposed in a decorative arrangement.

The environmental packaging assembly of the present invention is shown in FIGS. 1-19 and takes one of several embodiments. FIGS. 1-4 show a first embodiment of the environmental packaging assembly comprising a generally cylindrical candle indicated generally at 10. FIG. 5-6 show a second embodiment of the environmental packaging assembly comprising a cube-shaped candle indicated generally at 110. FIG. 7 shows a third embodiment of the environmental packaging assembly comprising a generally cube-shaped candle indicated generally at 210 that has at least a portion of its top end decorative finished with curves. FIGS. 8*a* and 8*b* show a fourth embodiment of the environmental packaging assembly comprising a hexagonal candle indicated generally at 310. FIGS. 9-11 shows a fifth embodiment of the environmental packaging assembly comprising a uniquely shaped candle indicated generally at 410. FIG. 12 shows a sixth embodiment of the environmental packaging assembly comprising a heart-shaped candle indicated generally at 510. FIGS. 13-15 show a seventh embodiment of the environmental packaging assembly comprising a plurality of candle portions that together form a generally cylindrical candle indicated generally at 610. Finally, FIGS. 16-19 show an eighth embodiment of the environmental packaging assembly comprising a plurality of candle portions that together form a generally square or cruciform candle indicated generally at 710.

Referring to FIGS. 1-4, environmental packaging assembly 10 comprises a candle 12. Candle 12 includes a wall 14 composed of a solid combustible fuel such as one made from any wax material, such as a natural wax, a paraffin wax, or any other suitable vaporizable material. Wall 14 preferably is composed of a material which is aesthetically pleasing to a consumer in its primary use as product packaging and in its secondary use as a candle that will be consumed if a wick 18 therein is ignited. While the preferred embodiment is shown and described with the product packaging material being a candle formed from natural wax, any suitable material within the spirit and scope of the present invention may be utilized, including but not limited to soy wax, palm wax, bee's wax, paraffin wax, or any other suitable wax, with or without a hardener and with or without fragrance incorporated therein. Wall 14 is formed by any suitable method, including but not limited to extrusion or molding. Wall 14 has a top end 14*a*, a bottom end 14*b* and exterior and interior sides 14*c*, 14*d* that extend between top and bottom ends 14*a*, 14*b*.

In accordance with a specific feature of the present invention, wall 14 of candle 12 defines a cavity 16 therein. Cavity 16 is bounded and defined by interior side 14*d* and is sized and shaped so as to be able to receive at least a portion of a product to be packaged therein. It will be understood that cavity 16 may be molded so as to be exactly complementary to the exterior surface of the product that is going to be retained therein or may be shaped differently from the product. Cavity 16 has a first opening 16*a* defined in top end 14*a* of wall 14 and the products to be retained in environmental packaging assembly 10 are introduced into cavity 16 through first opening 16*a* and are similarly removed therefrom through first opening 16*a*.

Figure 2:
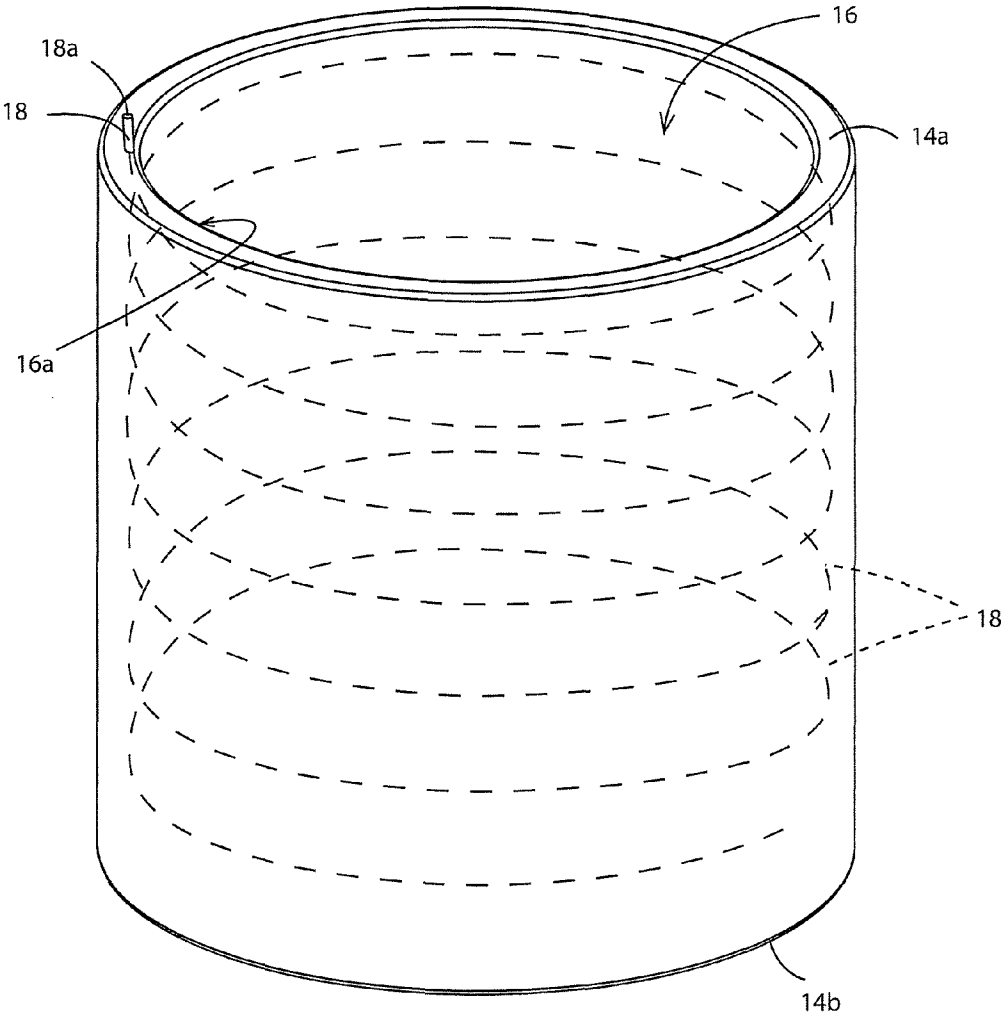
FIG. 2 is a perspective view of the candle of FIG. 1 showing the placement of the wick within the wall of the candle.

Wick 18 is embedded in wall 14 between an interior surface and an exterior surface thereof and, as illustrated in FIG. 2, wick 18 preferably extends from proximate bottom end 14*b* of wall 14 to proximate top end 14*a* thereof. A length of wick 18 projects above top end 14*a* and terminates in a tip 18*a*. Preferably, wick 18 is positioned so that it is closer to the interior surface of wall 14 bounding cavity 16 than it is to the exterior surface thereof. When wick 18 is positioned in this way and when candle 12 is burned, any wax that drips downwardly will tend to drop into cavity 16 and thereby be more effectively contained. It will of course be understood that wick 18 can, however be located anywhere in wall 14 or be disposed so that only a portion of the wick 18 is embedded in the wall.

In accordance with one of the specific features of the present invention, wick 18 preferably is embedded within wall 14 and is configured in one of a coiled, helical or spiral configuration or in any other configuration that will result in wick 18 effectively encircling cavity 16 and extending from somewhere near to the bottom of wall 14 to somewhere near to the top of wall 14. It should be understood that the term "encircle" used herein is meant to describe any manner of placing the wick 18 within wall 14 that will cause the wick to substantially surround the cavity in such a manner that when burned, the wick 18 will substantially consume a major portion of the candle wall 14. The term "encircle" should not be construed to imply that the wick must take some arcuate form only.

Wick 18 preferably is disposed throughout the vertical wall 14 in a generally spiral, coiled or helical shape to permit substantially complete vaporization of wall 14 as the wick 18 burns. For the sake of safety, wick 18 should preferably end around ½-1 inch (1.5-2.5 cms) away from the bottom end 14*b* of wall 14 with the shorter distance being utilized in candle 12 is to be positioned on a non-combustible base as will be hereinafter described.

A plurality of rows of wick 18 preferably is incorporated into wall 14 so as to enable a consistent and full burn of the wall 14. For example, as many as seven rows of the wick 18 may be incorporated into wall 14. It will be understood, however, that any number of rows may be utilized without departing from the spirit and scope of the present invention.

Figure 1:
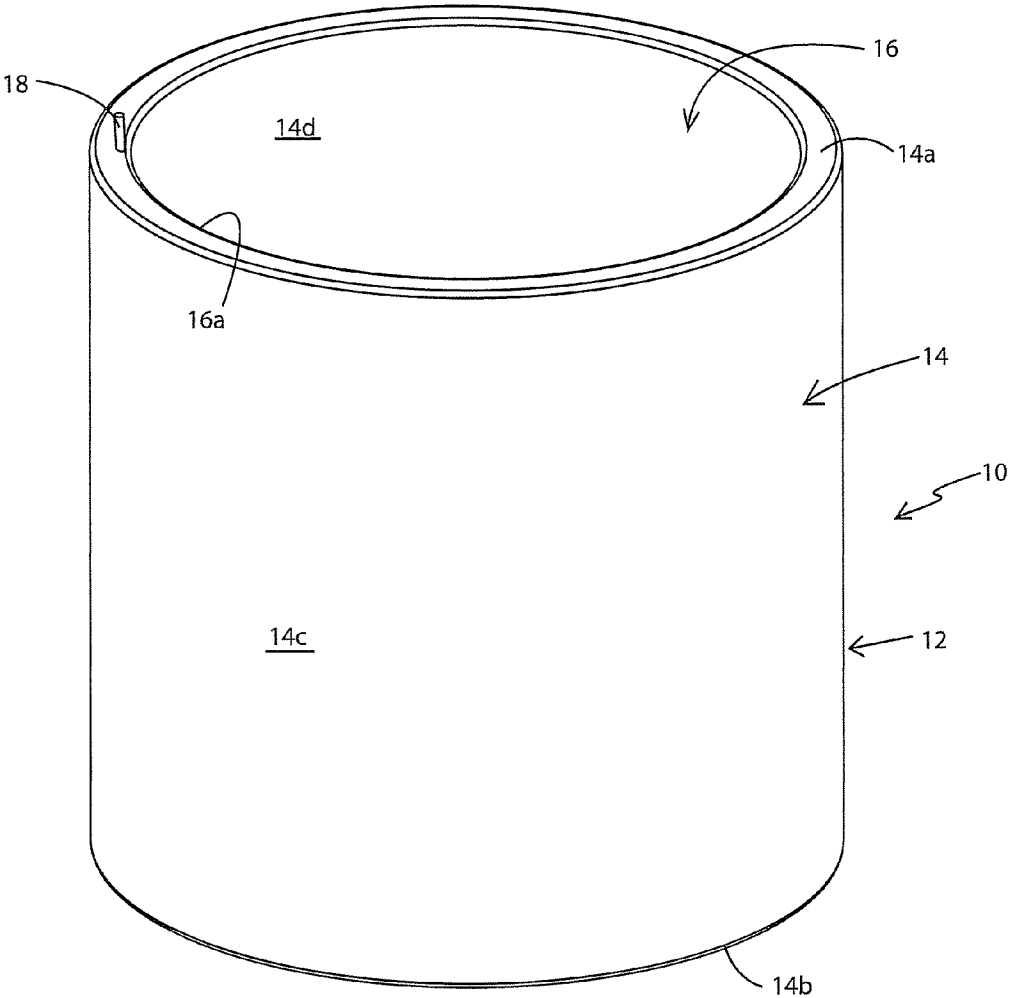
FIG. 1 is a perspective view of a candle that is utilized as a first preferred embodiment of an environmental packaging assembly in accordance with the present invention.

It should be understood that while a spiral, coiled or helical configuration has been illustrated in FIG. 1, other patterns of wick such as a zigzag pattern or any other pattern that will migrate back-and-forth within the wall 14 or will surround the cavity 16 can be utilized to ensure that the consumption of the wall is as complete as possible during combustion. It will further be understood that wick 18 can be arranged to mimic and surround any shape of cavity 16 in any shape of candle 12. All of these variations are considered to fall within the scope of this invention.

Figure 3:
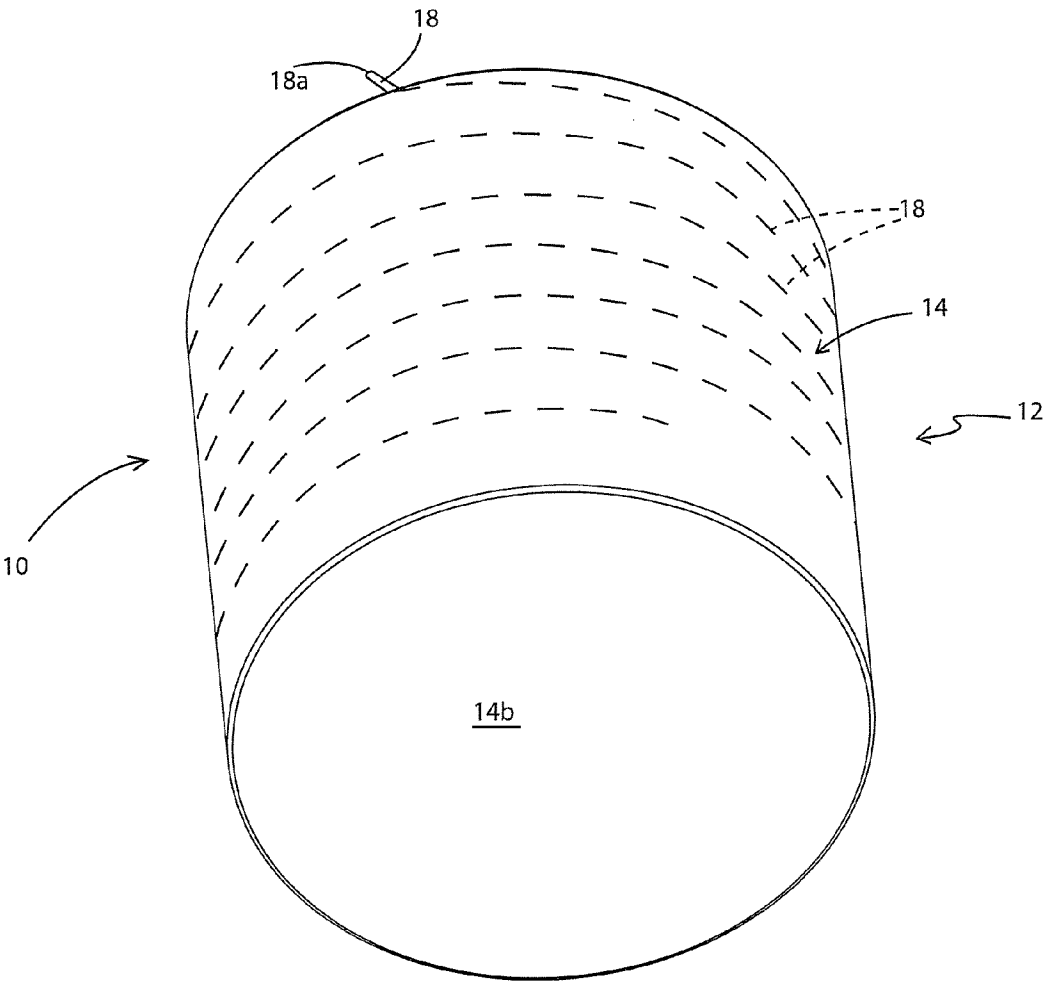
FIG. 3 is a perspective view of the candle of FIG. 1 showing the bottom end of the candle.

Referring to FIG. 3, bottom end 14*b* of wall 14 may be substantially solid and continuous with wall 14 so that cavity 16 is bounded and defined by interior side 14*d* of wall 14 together with the substantially continuous bottom end 14*b* thereof. Alternatively, bottom end 14*b* may be formed of an alternative material such as plastic or ceramic and wall 14 may be molded thereto so that this alternative material bottom end is substantially continuous with wall 14.

Figure 4:
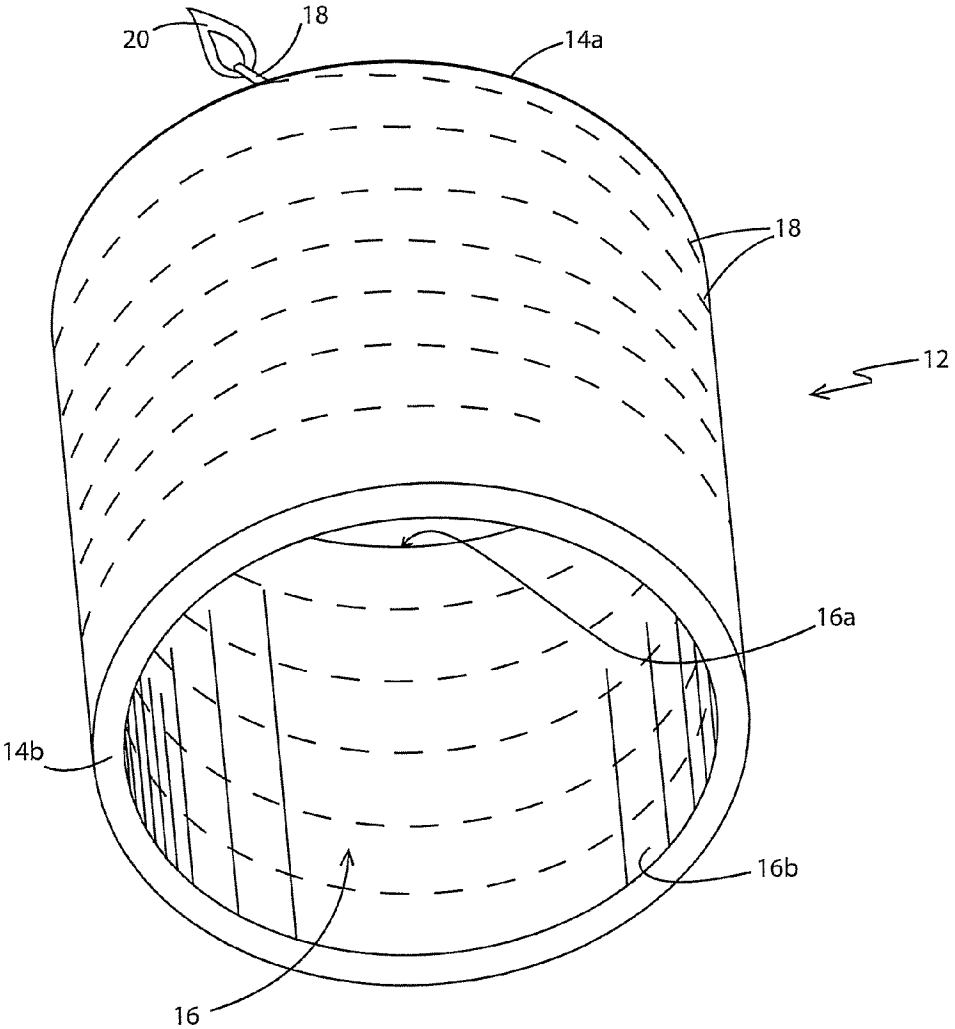
FIG. 4 is a perspective view of an alternative bottom end of the candle.

FIG. 4 illustrates an alternative type of bottom end 14*b* to wall 14. In this instance, a second opening 16*b* to cavity 16 is defined in bottom end 14*b* of wall 14. Thus, candle 12 is substantially tubular in nature having a first opening 16*a* to cavity 16 in top end 14*a* thereof and a second opening 16*b* to cavity 16 in bottom end 14*b* thereof. As with the previous version, the wick 18 is embedded in wall 14 in a spiral, coiled or helical configuration that encircles cavity 16. Again, wick 18 preferably extends from proximate bottom end 14*b* of wall 14 to proximate top end 14*a* thereof. Thus, when wick 18 is ignited, as shown in FIG. 4, the flame 20 will burn wick 18 and vaporize the wax and will combust the same until wall 14 is substantially completely consumed. Preferably, the substantially tubular candle 12 illustrated in FIG. 4 will be placed on a base (not illustrated in this figure) to capture any wax melting off candle 12.

The configuration of candle 12 permits a product to be received within cavity 16 and to thereby be thoroughly secured within the interior of a structurally sound, single piece of packaging. Once the product is removed from cavity 16, the consumer is able to use the packaging assembly 10 for a secondary purpose, i.e., as a candle, and thereby simultaneously significantly reduce any waste materials generated by packaging the product in assembly 10.

FIGS. 5 & 6 illustrate a second embodiment of an environmental packaging assembly in accordance with the present invention and generally indicated at 110. Assembly 110 comprises a substantially square candle 112 made up from a wall 114 of combustible fuel as previously described in relation to wall 14. Wall 114 has a top end 114*a*, a bottom end 114*b* and sides 114*c*, 114*d*, 114*e*, 114*f* extending between top and bottom ends 114*a*, 114*b*. Wall 114 preferably is unitary in construction and may be made by a suitable process such as molding. Wall 114 bounds and defines a cavity 116 that has a first opening 116*a* in top end 114*a* and where the bottom end 114*b* is substantially solid and continuous. One or more products 122 are placed into cavity 116 and are retained therein. A wick 118 is embedded in wall 114. As with the previous embodiment, wick 118 is embedded in a spiral, coiled or helical fashion and encircles cavity 116. A first end of the wick 118 extends for a distance beyond top end 114*a* of wall 114 and a second end of wick 118 is disposed proximate bottom end 114*b* of wall 114. Thus, when wick 118 is ignited, substantially the entire wall will be consumed.

In accordance with yet another feature of the present invention, the environmental packaging assembly in accordance with the present invention may include a containment mechanism for securing products within the cavity in the candle. This is illustrated in FIG. 7 where a third embodiment of the environmental packaging assembly in accordance with the present invention is shown and generally indicated at 210. Assembly 210 includes a candle 212 and a first containment mechanism 224. Candle 212 has a wall 214 that is generally cubic in shape having a top end 214*a*, a bottom end 214*b* and sides 214*c*, 214*d*, 214*e* and 214*f* that are all disposed substantially at right angles to each other. The top end 214 includes one or more arcuate or curved regions 226. Additionally, one or more of sides 214*c*-214*f* is provided with ridges or grooves 228 to make the exterior of candle 212 more visually pleasing. Wall 214 defines a cavity 216 therein into which a product 222 may be inserted. The containment mechanism 224 is engaged with candle 212 to retain the product 222 in cavity 216. The containment mechanism 224 is essentially a lid for the cavity 216. In FIG. 7, the containment mechanism 224 takes the form of a band of sheet material such as a paper strip or length of ribbon. Containment mechanism 224 obstructs at least a portion of the first opening 216*a* to cavity 216 and thus restricts access to cavity 216 and prevents removal of product 222 therefrom. The sheet material may be secured to itself or may be secured by an adhesive 229 to a portion of wall 214 of candle 212. Indicia 230 such as corporate logos, advertising text or instructions may be provided on containment mechanism 224.

The environmental packaging assembly 210 is used in the following manner. Assembly 210 is delivered to the consumer in the form illustrated in FIG. 7. The consumer breaks or removes containment mechanism 224 and is then able to remove product 222 from cavity 216. Once product 222 is removed, the consumer is then able to utilize the candle 212 in its secondary function by lighting wick 218. As with previously disclosed candles 12, 112, wick 218 is embedded in wall 214 in one of a spiral, coiled or helical fashion and preferably is configured to encircle cavity 216. Although not illustrated herein, it will be understood that the wick 218 may be coiled through the wax that forms bottom end 214*b* of candle 212 as well. Thus, when wick 218 burns, substantially the entire candle 212 is consumed. The consumer consequently not only benefits from receiving two products in one—the product 222 and the candle 212 but also generates little to no waste that subsequently has to be disposed of in that only containment mechanism 224 has to be thrown away.

There are instances where it may be desirable to leave product 222 disposed within the cavity 216 and to ignite the wick 218 while the product 222 remains contained within candle 212. Such an instance would be if the product 222 was, for example, a religious artifact such as a statue of a saint. The user could then leave the statue in place in cavity 216, burn the candle 212 and then remove the statue once the candle wall 214 was essentially burned away. The remnant of the wall 214 could then be recycled or disposed of.

FIG. 8*a* is a perspective view of a fourth embodiment of a candle 312 used as an environmental packaging assembly that is generally indicated at 310. The wall 314 of candle 312 is generally hexagonal in shape and a cavity 316 is defined by wall 314. Cavity 316 may take any shape such as the cylindrical shape illustrated in FIG. 8*a*. It will be understood, however, that a hexagonal cavity could have been defined in wall 314 instead or cavity 316 could have been molded to be complementary to a specific product. A wick 318 is embedded in wall 314 and is configured to be a spiral, helix or coil that encircles cavity 316. A second type of containment mechanism is utilized in assembly 310 and is generally indicated at 324. In this instance, containment mechanism 324 is a lid that includes a portion 332 of dimensions that are configured to be complementary to the first opening 316*a* of cavity 316. The lid also includes a shoulder 334 that is configured to be seated in abutting contact with top end 314*a* of wall 314 when lid 324 closes off access to cavity 316. Preferably, as shown in FIG. 8*b*, portion 332 is comprised of a combustible material similar to candle 312 and is provided with a second wick 336. Second wick 336 may or may not be coiled or spiraled within the portion 332. The rest of lid 324 other than portion 332 preferably is made from a durable and non-combustible material such as ceramic.

Environmental packaging assembly 310 is used in the following manner. A product (not shown) is inserted into cavity 316. Lid 324 is placed to close off access to cavity 316 by inserting portion 332 thereof into first opening 316*a*. Lid 324 is pushed downwardly until shoulder 334 on lid 324 abuts top end 314*a* of wall 314. Lid 324 may be retained in engagement with candle 312 by friction alone. Alternatively, a strip of sheet material similar to containment mechanism 24 may be secured around lid 324 and candle 312. Still further, an adhesive (not shown) such as wet wax or glue may be applied between shoulder 334 and/or portion 332 and top end 314*a* of wall 314. When the consumer receives assembly 310, they remove lid 324, remove the product contained in cavity 316 and are then able to combust candle 312 by lighting wick 318. Additionally, lid 324 may be inverted as illustrated in FIG. 8*b* and wick 336 may be set alight. Lid 324 thereby is able to be used as a tea light independent of candle 312. As wicks 318, 336 burn, the combustible material of candle 312 and/or lid 324 is vaporized and thereby consumed. Ultimately, the majority of the packaging assembly 310 within which the product was packaged and transported, is consumed, with only the non-combustible portion of lid 324 and a small portion of candle 312 remaining. The remaining wax of candle 312 may be recycled or thrown away. The ceramic portion of lid 324 may be used as a candle tart or drip tray for another candle (not shown). In this way the waste that would normally be generated by prior art packaging for the product is substantially reduced.

Alternatively, lid 324 may be formed of a material different to candle 312, such as ceramic, cork or a combination of the same, and will not be provided with a wick. Furthermore, 332 on lid 324 may be provided with threads (not shown) that will mate with threads (not shown) molded into interior surface of wall 14. In this instance, lid 324 may be separately used as a candle tart upon which other candles (not shown) may subsequently be placed and burned. Still further, lid 324 may be positioned beneath a candle such as that illustrated in FIG. 4 and thereby become a container onto which melting wax can drip.

FIGS. 9-11 illustrate a fifth embodiment of a candle 412 utilized as an environmental packaging assembly 410 in accordance with the present invention. Candle 412 is configured in a unique and aesthetically pleasing shape and the wall 414 thereof defines a cavity 416 into which product 422 is received. A third type of containment mechanism for closing off access to cavity 416 in candle 412 is illustrated and generally indicated at 438. Lid 438 is configured to be complementary in shape to candle 412 and includes a bottom end 438*b* that is configured to be seated in abutting contact on top end 414*a* of wall 414. Although not shown, it will be understood that lid 438 also defines a cavity into which a portion of product 422 will be received when lid 438 is engaged with candle 412. FIG. 10 shows that candle 412 includes a wick 418 embedded in wall 414 and is coiled or spiraled in such a manner within wall 414 that it effectively encircles or circumscribes cavity 416. Wick 418 extends from proximate bottom end 414*b* of wall 414 and projects for a distance above top end 414*a* of wall 414. In accordance with a specific feature of the present invention, a layer of adhesive 440 is applied between top end 414*a* of candle wall 414 and bottom end 438*b* of lid 438. The adhesive layer 440 may be comprised of any suitable material that will seal lid 438 to candle 412 and includes glue or wax. A pull tab 442 is positioned in adhesive layer 440 and a region thereof extends outwardly from candle 412.

When the consumer receives the environmental packaging assembly 410 it looks like the illustration in FIG. 11. The consumer grasps the portion of pull tab 442 that extends outwardly from adhesive layer 440 and pulls the same outwardly from candle 412 in either direction indicated by arrow "A". This movement breaks the seal of adhesive layer 440. The consumer may then remove lid 438 and access product 422 in cavity 416. Once product 422 has been removed from cavity 416, the consumer can light the wick 418 and vaporize candle 412. It will be understood that the adhesive layer 440 may be made from wax or any other suitable material that secures lid 438 to candle 412.

It should be noted that lid 438 may be made from a vaporizable material as is candle 412, and may be provided with an embedded wick to burn the same. Alternatively, lid 438 may be made from any material that may be recycled, such as box-board. Still further, lid 438 may be made from a material that renders lid reusable, such as plastic or ceramic so that lid 438 may be used as a decorative dish, for example.

FIG. 12 is a perspective view of a sixth embodiment of a candle 512 that is utilized as an environmental packaging assembly 510 in accordance with the present invention. In this instance, candle 512 is heart-shaped and includes a wall 514 that defines a heart-shaped cavity 516 therein. Once again, a wick 518 extends outwardly from wall 514 and preferably is embedded within wall in such a manner that it spirals or coils around cavity 516 and extends from proximate top end 514*a* to bottom end 514*b* thereof. Access to cavity 516 is restricted by a fourth type of containment mechanism 524. In this instance, containment mechanism 524 is a peel-off lid that is adhesively secured to candle 512. Suitable materials for lid 524 include paper, adhesive paper, plastic, aluminum, fabric or any flexible type of material or blown film.

When the user wishes to access a product packaged within cavity 516, they simply grasp a tab 542 on lid 524 and peel the same off top end 514*a* of wall 514. Once a product (not shown) has been removed from cavity 516, the consumer can light wick 518 to burn up candle 512. The peel-off lid 524 may be thrown away or recycled, depending on the type of material it is constructed from. It will be understood that a film type of lid may be made from a clear plastic wrap, for example.

FIGS. 13-15 illustrate a seventh embodiment of a candle 612 that is utilized as an environmental packaging assembly 610 in accordance with the present invention. As best seen in FIG. 14, candle 612 is comprised of a plurality of individual candle members 612*a*, 612*b*, 612*c*, 612*d*, 612*e*, 612*f*. The plurality of candle members 612*a*-612*f* is configured to be complementary engaged with each other or butted up against each other so that they form a generally circular candle 612 that defines a generally circular cavity 616 therein. The cavity 616 is sized to receive products 622 therein. It will be understood that the candle members 612*a*-612*f* may be adhered to each other by a thin wax layer or other adhesive that can subsequently be broken so that the candle members may be separated from each other. Each candle member 612*a*-612*f* has its own wick 618 that is embedded in the wall 614 thereof. The wick 618 in any of the candle members may extend substantially vertically from the top end 614*a* of wall 614 to proximate the bottom end 614*b* thereof or it may be coiled or wound back and forth through the wall 614. Thus, because wicks 618 are placed at intervals around cavity 616 defined by the plurality of candle members 612*a*-612*f*, the wicks 618 effectively encircle the cavity 616. The candle members 612*a*-612*f* each include grooves 646 in their sides to enable a consumer to pull an individual candle member out of the arrangement. In order to keep the candle members 612*a*-612*f* in the circular arrangement, a base member 650 is provided. Candle members 612*a*-612*f* are placed in base member 650 so that their bottom ends are in abutting contact with an interior surface of base member 650. A fifth embodiment of a containment mechanism 624 is placed over the top ends 614*a* of candle members 612*a*-612*f*. Containment mechanism 624 and base member 650 may be substantially identical in size and shape and may engage candle members 612*a*-612*f* by friction alone. Both containment mechanism 624 and base member 650 preferably comprise a unit having a planar annular base 652 with a vertical perimeter wall 654 extending outwardly from the base's circumference. Base 652 may, alternatively, extend substantially continuously across the entire circular region defined by wall 654 and base member 650 may therefore be useful as a drip tray for the candle 612. Preferably, containment mechanism 624 and base member 650 are made from a recyclable material, such as tin, aluminum or a hard plastic, or may include a layer of the same. Advantageously, the tin, aluminum or plastic enables packaging assembly 610 to sit on any type of surface as the material thereof affords protection to the surface from potential damage caused by melting wax. Alternatively, containment mechanism 624 and base member 650 may be made from a combustible or vaporizable material similar to candle 612 and may be utilized as a candle tart. Additionally, if containment mechanism 624 and base member 650 are made from wax, they may also be provided with an embedded wick so that they may be used as independent candles. It will also be understood that the lid 624 could be inverted and used as a drip tray to capture wax from a burning candle.

When the consumer receives environmental packaging assembly 610 as illustrated in FIG. 13, they remove lid 624 therefrom, thereby gaining access to products 622 in cavity 616 (FIG. 14). Once products 622 are removed, each candle member 612*a*-612*f* may be combusted by lighting wicks 618. The consumer may also remove base member 650 and may arrange the candle members 612*a*-612*f* in a more decorative arrangement such as shown in FIG. 15. Although not illustrated herein, candle members 612*a*-612*f* may be separated from each other and used alone or arranged in different configurations.

Figure 16:
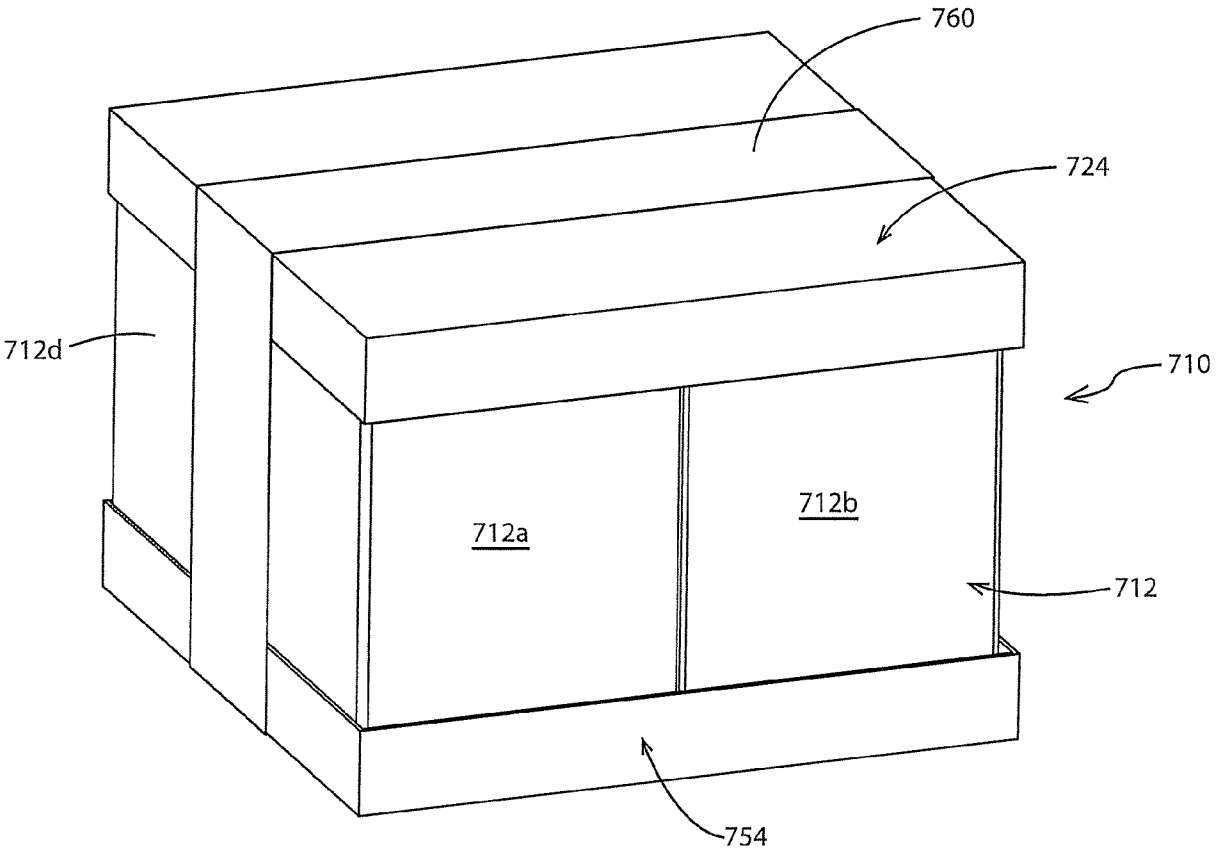
FIG. 16 is a perspective view of an eighth embodiment of a candle that is utilized as an environmental packaging assembly in accordance with the present invention.
Figure 17:
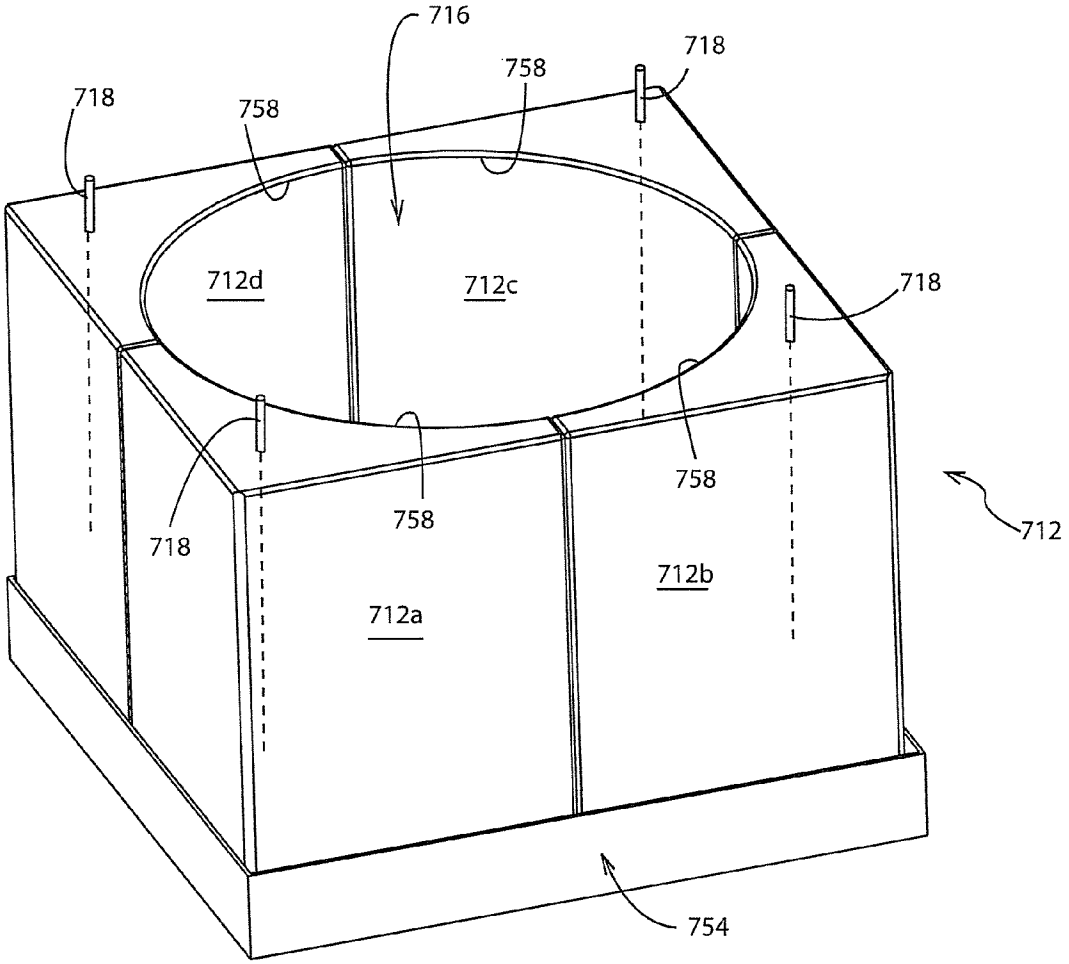
FIG. 17 is a perspective view of the candle of FIG. 16 with the containment mechanism and securement member removed and showing the several individual candle portions that are configured to form a cavity within which a product may be received.
Figure 18:
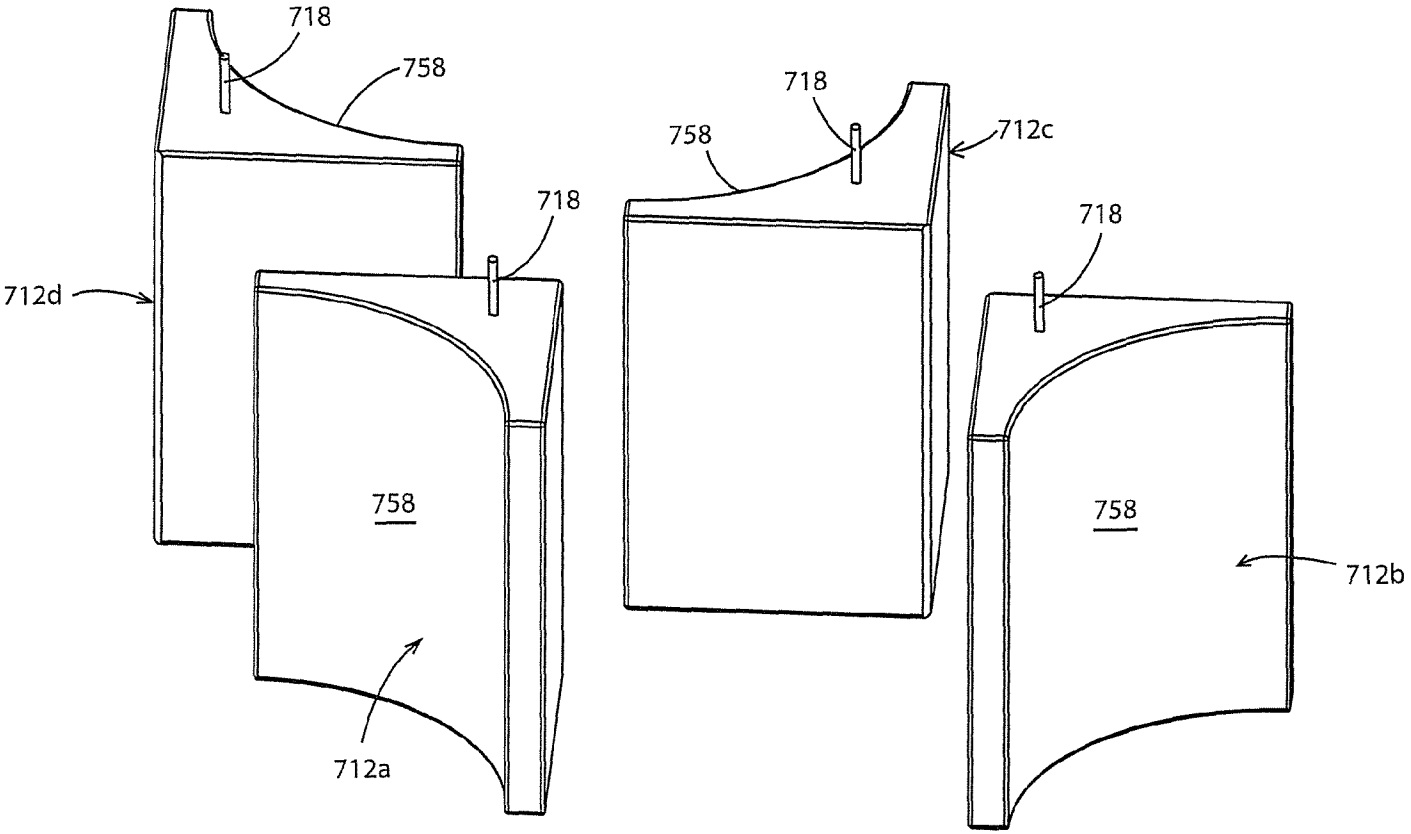
FIG. 18 is a perspective view of the several candle portions of the candle of FIG. 16 removed from the base and disposed in a decorative arrangement separated from each other.

FIGS. 16-19 show an eighth embodiment of a candle 712 that is utilized as an environmental packaging assembly 710 in accordance with the present invention. Once again, candle 712 is comprised of a plurality of individual candle members 712*a*, 712*b*, 712*c*, 712*d* that are configured to form a candle 710 that is generally square in cross-sectional shape when viewed from above. Each candle member 712*a*-712*d* includes a wick 718 that either extends from proximate the top end 714*a* of the candle member through to the bottom end 714*b* thereof (as shown in FIG. 17). Wick 718 may, alternatively, be coiled or threaded back and forth through the candle member. Each candle member 712*a*-712*d* has a concave surface 758 (FIG. 18) that extends from the top end to the bottom end thereof and defines a portion of the cavity 716 defined by candle 712. As with the previous embodiment, a base member 754 and lid 724 are frictionally engaged with the bottom ends 714*b* and top ends 714*a* of the plurality of candle members 712*a*-712*d*. Lid 724 is a substantially solid member that may be manufactured from a variety of materials that may be reused or recycled. A product (not shown) may be inserted into cavity 716 prior to lid 724 being applied to candle 712. A securement mechanism 760 such as a length of paper tape may be used to secure lid 724, candle 712 and base member 754 together.

The consumer receives the environmental packaging assembly 710 as illustrated in FIG. 16, removes securement mechanism 760, removes containment mechanism or lid 724, removes the product from the cavity 716 and then can light the wicks 718 of the candle members 712*a*-712*d* when they are standing in base member 754 as illustrated in FIG. 17. Alternatively, the individual candle members 712*a*-712*d* may be removed from base member 754 and then used individually as illustrated in FIG. 10. Still further, the candle members 712*a*-712*d* may be rearranged within base member 754 into a different configuration, such as the cruciform shape shown in FIG. 19.

Figure 19:
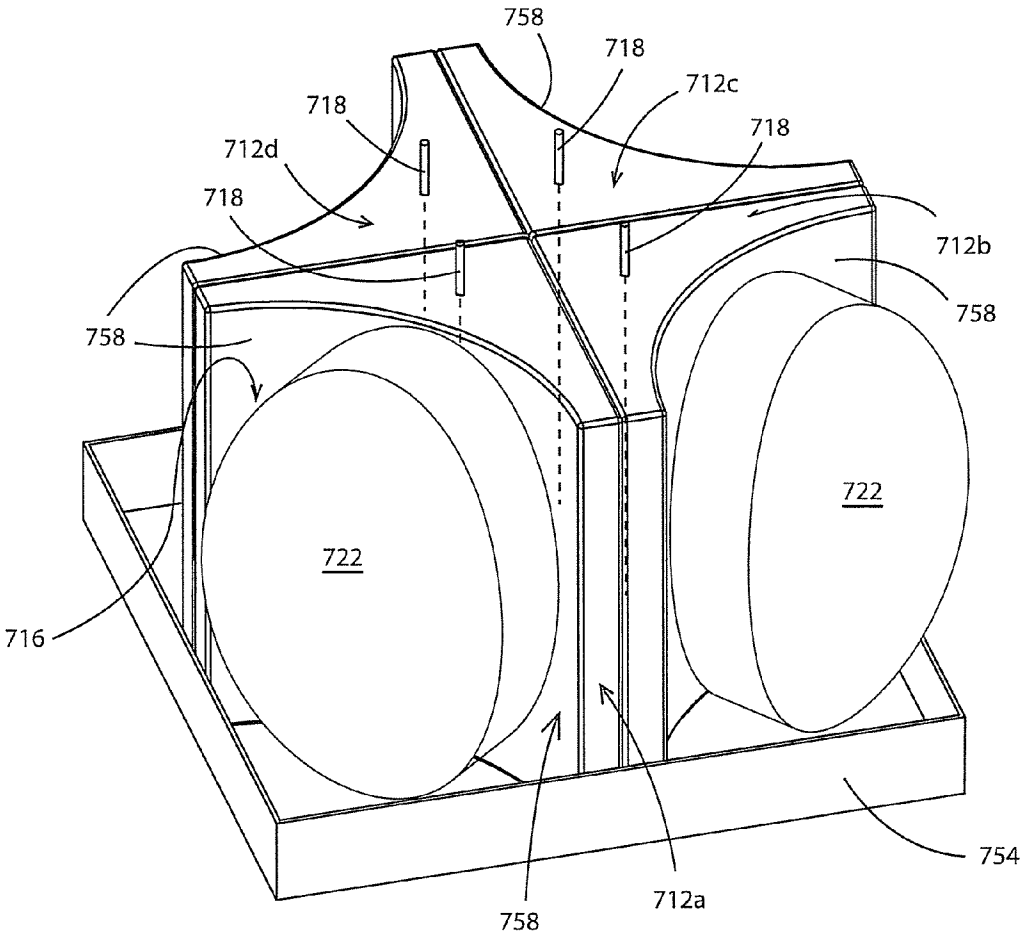
FIG. 19 is a perspective view of an alternative arrangement of the candle portions of the candle of FIG. 16 showing the containment mechanism removed and the candle portions arranged differently in the base and showing a plurality of cavities for securing products against the candle portions.

It should be noted that candle members 712*a*-712*d* may, alternatively, be initially positioned in the cruciform shape shown in FIG. 19 and products 722 may be positioned adjacent the curved surfaces 758 of each candle member 712*a*-712*d*. The cruciform candle 712 so formed then includes four cavities each defined by one of the curved surfaces 758 of one of the candle members 712*a*-712*d* and a portion of base member 754. A clear plastic wrap may be engaged around candle members 712*a*-712*d* and base member 754 so that products 722 are clearly visible to the consumer. Alternatively, the containment mechanism 724 and securement mechanism 760 may be positioned over the top ends of candle members 712*a*-712*d* thus locking products 722 in the assembly 710. In either of these configurations, it is possible for the consumer to view products 722 retained within a portion of the cavities defined by the surfaces 758 of candle members 712*a*-712*d* and portions of base member 754 and containment member 724 before they open the assembly 710. The products 722 are prevented from falling out of the assembly 710 by containment mechanism 724 and base member 754.

It should further be understood that a single cruciform candle can replace the four candle members 712*a*-712*d*. In this instance, the wick 718 can simply extend from the top end 714*a* of the candle 712 to the bottom thereof or the wick may be coiled or spiraled within the interior of the candle 712.

Figure 20B:
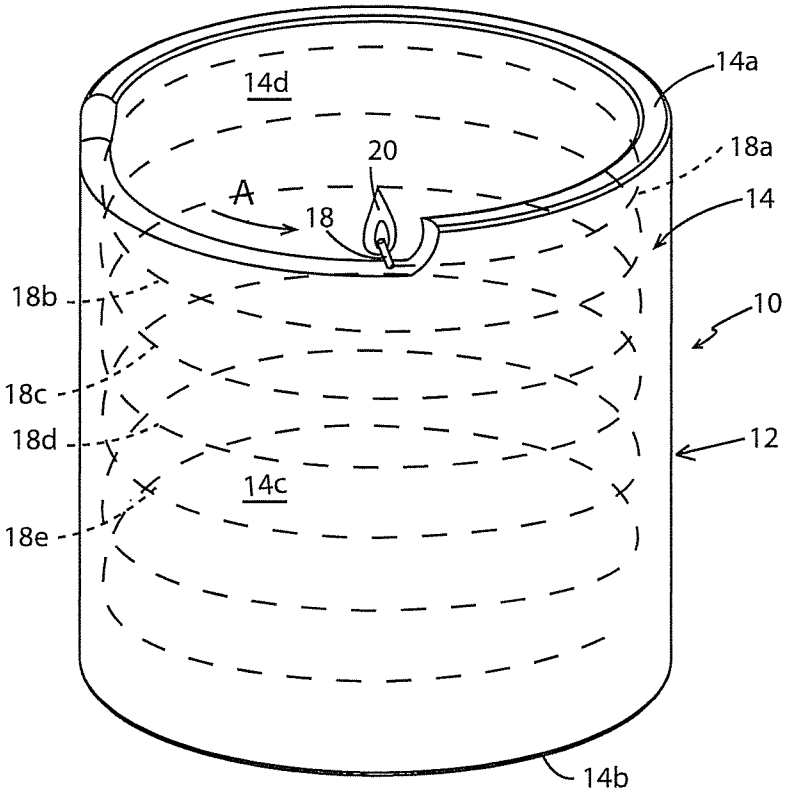
FIG. 20*b* is a perspective view of the first embodiment of the environmental packaging assembly shown after a first quarter of the first spiral row of the wick has been burned and the associated portion of the candle has been consumed.
Figure 20A:
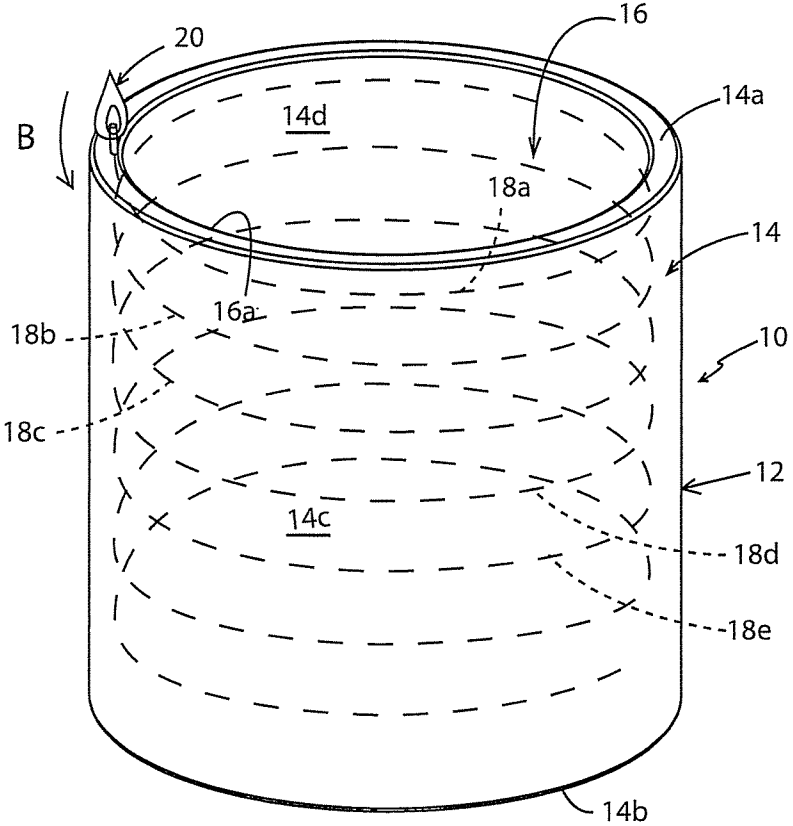
FIG. 20*a* is a perspective view of the first embodiment of the environmental packaging assembly shown immediately after the wick has been set alight.
Figure 20D:
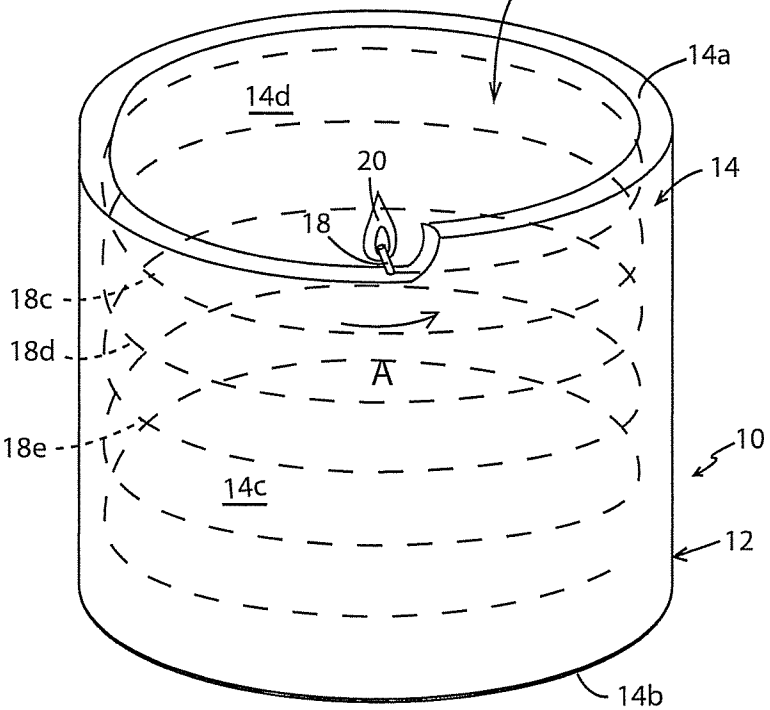
FIG. 20*d* is a perspective view of the first embodiment of the environmental packaging assembly shown after a first quarter of the second spiral row of the wick has been burned and the associated portion of the candle has been consumed.
Figure 20C:
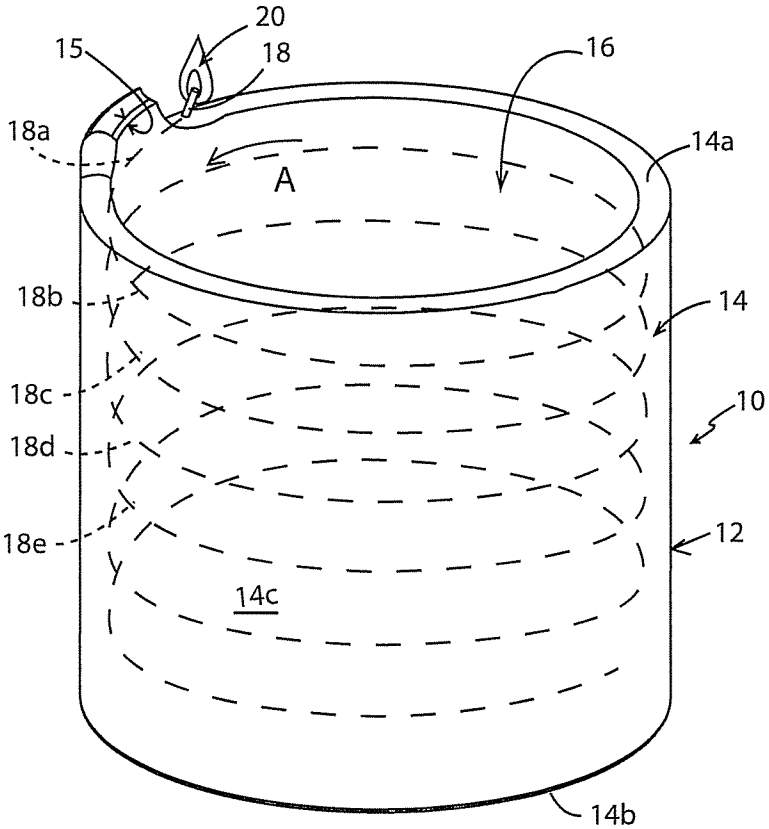
FIG. 20*c* is a perspective view of the first embodiment of the environmental packaging assembly shown after almost the entire first spiral row of the wick has been burned and the associated portion of the candle has been consumed and only a small remnant of the original top end of the candle remains untouched.
Figure 20F:
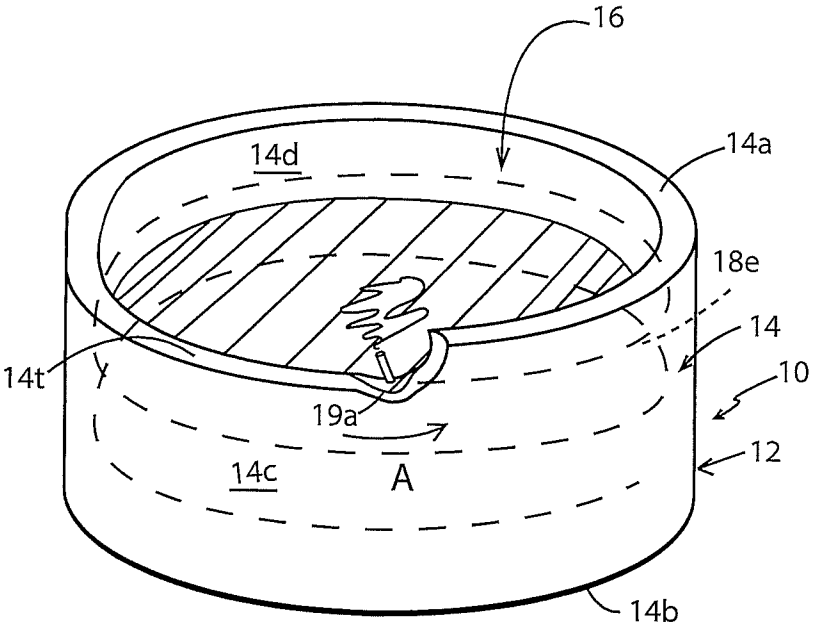
FIG. 20*f* is a perspective view of the first embodiment of the environmental packaging assembly shown when an additional row of the spiral wick has been consumed and the wick has reached the upper surface of the non-combustible liquid placed in the cavity and that non-combustible liquid has effectively extinguished the flame.
Figure 20E:
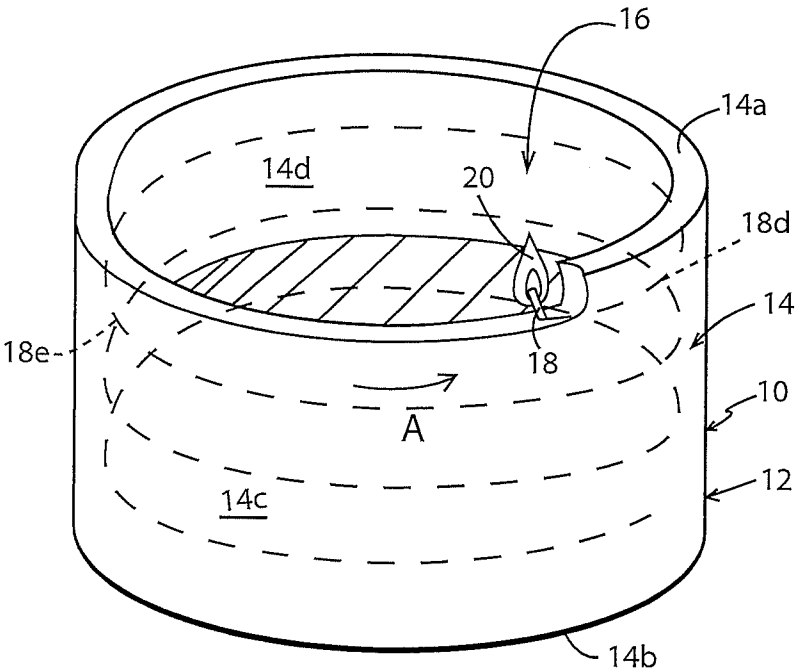
FIG. 20*e* is a perspective view of the first embodiment of the environmental packaging assembly shown after a first quarter of the fourth spiral row of the wick and the associated portion of the candle has been consumed and an upper surface of a non-combustible liquid retained within the cavity is visible a short distance downwardly from the top surface of the burning candle.

Referring now to FIGS. 20*a*-20*e*, there is shown candle 12 being burned once a product that was previously contained in cavity 16 has been removed. FIG. 20*a* shows candle 12 immediately after wick 18 has been set alight and a flame 20 can be seen. Arrow "B" indicates the direction in which the first spiral row 18*a* of wick 18 extends and is consumed. FIG. 20*b* shows candle 12 after a first quarter of first spiral row 18*a* of wick has been burned and the associated portion of the candle has been consumed. FIG. 20*c* shows candle 12 after almost the entire first spiral row 18*a* of wick 18 has been burned and the associated portion of the candle has been consumed. Only a small remnant 15 of the original top end 14*a* of the candle wall remains untouched. FIG. 20*d* shows candle 12 after a first quarter of the second spiral row 18*b* of wick 18 has been burned and the associated portion of the candle has been consumed. FIG. 20*e* shows candle 12 when about two thirds of the wick 18 and the associated portion of the candle has been consumed and only a portion of the spiral row 18*d* and the spiral row 18*e* remain intact. FIGS. 20*e* and 20*f* also illustrate a safe way of extinguishing the flame 20.

It should be noted that after removing the product from cavity 16, the user can determine a length of time they wish to burn candle 12 and can then pour a quantity of a non-flammable liquid 19 into cavity 16 before they light wick 18. A suitable non-flammable liquid 19 for this purpose would be water. The quantity of water introduced into cavity 16 can be varied in accordance with the length of time the user wishes to burn the candle. The candle will burn for less time if the quantity of water is greater and will burn for more time if the quantity of water is smaller. So, for example, if the user wishes to burn the candle for a short time, they can introduce a quantity of water into cavity 16 that will come up to the level of row 18*b* of wick 18. If they wish to burn the candle for a longer time, they can introduce a quantity of water into cavity 16 that will come up to the level of row 18*e* of wick 18. FIG. 20*e* shows the upper surface of the liquid 19 disposed a short distance below the top end of remaining candle wall. When the top end 14*t* of the candle wall 14 is consumed to the point that it is at or slightly below the upper surface of liquid 19 (FIG. 20*f*), a small quantity 19*a* of liquid 19 will start to flow over the uppermost end 14*t* and will extinguish the burning wick 18. The user can predetermine how long they will permit the candle to burn by adjusting the level of liquid 19 placed into cavity 16. The greater the quantity of liquid 19 in cavity 16, the sooner the flame 20 will be extinguished. The smaller the quantity of liquid 19 in cavity, the longer candle 14 will burn. This type of automatic candle extinguishing is effective if the type of wax used to form wall 14 is less apt to drip and is most effective if the wax is of a type that completely vaporizes and does not drip at all.

As will be evident, because there are still additional rows of wick 18 embedded in wall 14 of candle 12, the user can burn the candle at a later time.

It will be understood by those skilled in the art that any desired shape candle may be created and utilized in the manner described herein. Furthermore, the cavity defined in a candle in accordance with the present invention may be of any desired cross-sectional shape. Additionally, that cavity can open on any of the top end, bottom end or sides of the candle. Still further, the wick may be arranged so as to encircle any desired shape of cavity in any location in the candle. As indicated in the description, the containment mechanisms for retaining the product in the cavity can partially or totally obstruct the cavity and can take any form that will function to retain the products therein. These containment and securement mechanisms may be made from combustible materials such as wax, from recyclable materials such as box-board or paper, from decorative materials that are usable as drip trays for the wax or for other purposes such as serving dishes. Alternatively, the containment and securement mechanisms may be manufactured from materials that are simply thrown away.

Additionally, it will be understood that while the candle of the present invention may be used as an alternative to a box or a container as is illustrated in FIGS. 1-19, it may instead be configured to replace items such as polystyrene beans, bubble wrap or any other material that is inserted into a container to occupy space or to cushion a product such as is illustrated in FIG. 19 herein.

It will further be understood that the type of wax used to manufacture the candles in accordance with the present invention may be of a type that melts and may be recycled or it may be of a type that vaporizes.

It will further be understood that the candle in accordance with the present invention may be utilized as a luminary in that tea lights or liquid combustible fuel may be placed in the cavity and may be burned independently or along with the wick in the candle.

It will additionally be understood that the type of products that are packaged in the environmental packaging assembly in accordance with this invention may be any suitable type of product or good that is normally packed into a box or other receptacle with or without product packaging such as polystyrene beans or supports, or with bubble wrap or other materials that lock the product in a fixed position within the box. Examples of such products include but are not limited to soap, lotion, hair products, cosmetics, perfume, candles, chocolates, beverages and the like.

It will further be understood that any of the walls of the candles used in the packaging assemblies disclosed herein may have a paper wrapper that is placed so as to surround an outer perimeter of the wall. This paper wrapper may include product information, advertising copy, or any other text and graphics.

It will further be understood that in each of the preferred embodiments described herein, the thickness of the wall of the candle utilized in the packaging assembly will be appropriately sized depending on the size and weight of the product (s) that are to be retained within the cavity. The wall thickness may vary depending on the desired size of the cavity and the overall desired size of the packaging assembly. For example, it has been found that wall thicknesses between 5 millimeters and 12 millimeters are suitable when a spiral-type wick is used. While these thicknesses have been shown to be suitable, any other size wall thickness may be incorporated without departing from the spirit and scope of the present invention, so long as the majority of the wall is vaporized during the secondary use of the packaging assembly. Additionally, if the thickness of the wall requires it, a plurality of wicks may be incorporated into the wall to ensure that the entire product packaging assembly is able to be vaporized.

Furthermore, it should be understood that while the environmental packaging assembly of the present invention is described herein as including a candle that defines a single cavity therein, candles that include more than one cavity therein are also considered to fall within the scope of the present invention. So, for example, if more than one product to be packaged and those products are fragile and could break if they contact each other, then more than one cavity may be molded into the candle.

Thus, the product packaging assembly in accordance with this invention provides an environmentally friendly way of shipping and displaying a product and has a secondary use that is environmentally friendly. It will be evident to a person skilled in the art that a variety of changes may be made that are within the spirit and scope of the present invention. For instance, the product packaging wall may be composed of any suitable material, the wick arrangement may be varied, and the wall thickness may be modified.

Accordingly, the product packaging is an effective, safe, inexpensive, and efficient device that achieves all the enumerated objectives of the invention, provides for eliminating difficulties encountered with prior art devices, systems, and methods, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

The invention claimed is:

1. A candle comprising:

a wall formed of a combustible fuel; said wall having a top end and a bottom end and sides extending therebetween;

a cavity bounded and defined by an inner surface of the sides of the wall; and a wick embedded in the sides of the wall in a one of a coiled, helical or spiral configuration; and wherein the wick is positioned so as to encircle the cavity and is located within the sides of the wall in a position that is closer to the inner surface of sides of the wall than to an outer surface thereof such that when the candle is burned, any wax that drips downwardly will tend to drop into the cavity and thereby be more effectively contained.

2. The candle as defined in claim 1, further comprising a first opening to the cavity defined in the top end of the wall, and wherein during burning of the wick, wherein combustible fuel of the wall that is melted by lighting the wick drops into the cavity through the first opening.

3. The candle as defined in claim 2, further comprising a containment member that is positionable to at least partially restrict access to the first opening to the cavity.

4. The candle as defined in claim 3, wherein the containment member is comprised at least partially of a combustible material; and a second wick is embedded in the containment member and the second wick is independently ignitable to consume the combustible material of the containment member.

5. The candle as defined in claim 3, wherein the containment member is fabricated from plastic or paper.

6. The candle as defined in claim 3, further comprising an adhesive material that secures the containment member to the candle wall.

7. The candle as defined in claim 6, further comprising a pull tab disposed to selectively break the adhesive material so as to release the containment member from the candle wall.

8. The candle as defined in claim 2, further comprising a base positioned at the bottom end of the wall and opposite the first opening to the cavity, said base preventing access to the cavity from the bottom end of the wall; and wherein combustible fuel of the wall that is melted by lighting of the wick accumulates on the base.

9. The candle as defined in claim 1, further comprising a second opening to the cavity defined in the bottom end of the wall.

10. The candle as defined in claim 9, further comprising:

a removable base positionable adjacent the bottom end of the wall, wherein the removable base at least partially restricts access to the second opening.

11. A method of packaging a product comprising:

providing a candle having a side wall formed of a combustible fuel; wherein the side wall defines a cavity; a wick embedded in the side wall in a configuration of one of a coil, a helix and a spiral that encircles the cavity and in such a way that the wick is closer to an inner surface of the side wall than to an outer surface of the side wall such that when the candle is burned, any wax that drips downwardly will tend to drop into the cavity and thereby be more effectively contained; and wherein the wick has a first end extending for a distance outwardly from a top end of the side wall;

inserting a product at least partially into the cavity; and positioning a containment mechanism on the candle in such a location as to secure the product with the cavity.

12. The method of packaging a product as defined in claim 11, further comprising the steps of:

removing the containment mechanism;

igniting the wick; and burning the candle until it is substantially entirely consumed.

13. The method of packaging a product as defined in claim 12, further comprising the step of:

removing the product from the cavity in the candle prior to the step of igniting the wick.

14. The method of packaging a product as defined in claim 12, further comprising the step of:

igniting a second wick embedded in a quantity of combustible material provided on the containment mechanism after the containment mechanism has been removed from the candle.

15. The method of packaging a product as defined in claim 12, further comprising the steps of:

removing the product from the cavity;

determining a period of time to burn the candle; and placing a quantity of liquid into the cavity to a depth sufficient to extinguish the candle automatically after the pre-determined period of time has passed.

16. The candle as defined in claim 1, wherein the wick originates at a lower end of the sides proximate the bottom end of the wall and extends to a terminal end proximate the top end of the wall; and substantially the entire wick encircles the cavity.

17. The candle as defined in claim 1, wherein the top end of the wall defines an opening therein that is of substantially a same diameter as the cavity and wherein the wick extends outwardly for a distance from the top end of the sides of the wall.

18. The candle as defined in claim 1, wherein the sides of the wall are of a thickness that is measured between the inner surface and the outer surface thereof; and wherein the wick is located between a central part of the thickness and the inner surface.

* * * * *